US008850770B2

(12) United States Patent
Roen

(10) Patent No.: US 8,850,770 B2
(45) Date of Patent: Oct. 7, 2014

(54) STRUCTURALLY INTEGRATED ACCESSIBLE FLOOR SYSTEM

(76) Inventor: Roger C. Roen, Spokane, WA (US)

( * ) Notice: Subject to any disclaimer, the term of this patent is extended or adjusted under 35 U.S.C. 154(b) by 541 days.

(21) Appl. No.: 12/468,767

(22) Filed: May 19, 2009

(65) Prior Publication Data

US 2009/0282766 A1 Nov. 19, 2009

Related U.S. Application Data

(63) Continuation-in-part of application No. 10/410,934, filed on Apr. 9, 2003, now Pat. No. 7,546,715, which is a continuation-in-part of application No. 09/887,772, filed on Jun. 21, 2001, now abandoned.

(51) Int. Cl.
*E04B 5/00* (2006.01)
*E04B 5/10* (2006.01)
*E04B 5/48* (2006.01)

(52) U.S. Cl.
CPC .... *E04B 5/10* (2013.01); *E04B 5/48* (2013.01)
USPC ..... 52/506.06; 52/263; 52/650.3; 52/653.1

(58) Field of Classification Search
USPC ..... 52/263, 506.01–506.1, 507, 220.6, 509, 52/510, 513, 650.3, 651.1, 653.1
See application file for complete search history.

(56) References Cited

U.S. PATENT DOCUMENTS 776,419 A 11/1904 Platt
1,031,043 A 7/1912 Conzelman
1,576,482 A 3/1926 Lehn
1,818,299 A 8/1931 Bowman
1,940,968 A 12/1933 Ohlis
2,017,911 A * 10/1935 Manske et al. ..... 52/506.08
3,025,934 A 3/1962 Spiselman et al.
3,065,506 A 11/1962 Tremer
3,180,460 A 4/1965 Liskey
3,263,388 A 8/1966 Bogert
3,396,501 A 8/1968 Tate
3,516,347 A 6/1970 May
3,583,121 A * 6/1971 Tate et al. ..... 52/22
3,685,235 A 8/1972 Lang
3,791,089 A * 2/1974 Alderman ..... 52/506.06
3,837,135 A * 9/1974 Zachman ..... 52/702
(Continued)

FOREIGN PATENT DOCUMENTS

GB 972383 A 10/1964
WO 03/000013 A2 1/2003

*Primary Examiner* — William Gilbert
*Assistant Examiner* — Patrick Maestri
(74) *Attorney, Agent, or Firm* — Seed IP Law Group PLLC

(57) ABSTRACT

A floor system for a building includes prefabricated grid sections attached to framing members of the building and a plurality of panels mounted to the grid to form a structurally integrated floor. The panels are removable to provide access to space below the floor that would otherwise be inaccessible in a conventional floor. A subfloor deck below the floor separates one building story from another and encloses the space between the floor and the deck, which can be used for temporary and permanent installations including, for example, pipes for water, laboratory gases, and compressed air, and power, telephone, and data cables; and as a plenum for HVAC. Either or both of the floor and the subfloor deck can be attached to the building frame to function as a diaphragm. The floor system replaces conventional permanent structural floors and raised accessible flooring systems.

32 Claims, 12 Drawing Sheets

(56) References Cited

U.S. PATENT DOCUMENTS

| | | | | | |
|---|---|---|---|---|---|
| 3,924,370 | A | | 12/1975 | Cauceglia et al. | |
| 4,229,919 | A | * | 10/1980 | Hughes | 52/263 |
| 4,344,262 | A | * | 8/1982 | Berman et al. | 52/223.12 |
| 4,348,841 | A | | 9/1982 | Ueno et al. | |
| 4,593,509 | A | | 6/1986 | Linton | |
| 4,628,645 | A | | 12/1986 | Tafelski, Jr. | |
| 4,630,417 | A | | 12/1986 | Collier | |
| 4,676,036 | A | | 6/1987 | Bessert | |
| 4,682,453 | A | | 7/1987 | Holmgren | |
| 4,841,709 | A | | 6/1989 | Peterson et al. | |
| 4,922,670 | A | | 5/1990 | Naka et al. | |
| 4,999,964 | A | | 3/1991 | Taylor | |
| 5,049,700 | A | | 9/1991 | Kobayashi et al. | |
| 5,079,890 | A | | 1/1992 | Kubik et al. | |
| 5,187,907 | A | | 2/1993 | Takeda et al. | |
| 5,323,575 | A | | 6/1994 | Yeh | |
| 5,341,614 | A | | 8/1994 | Shimizu | |
| 5,412,914 | A | | 5/1995 | Daw et al. | |
| 5,477,649 | A | | 12/1995 | Bessert | |
| 5,715,636 | A | | 2/1998 | Taylor | |
| 5,787,663 | A | | 8/1998 | Wehrmann | |
| 5,806,270 | A | | 9/1998 | Solano et al. | |
| 5,885,154 | A | | 3/1999 | Napadow et al. | |
| 5,953,870 | A | | 9/1999 | Jette | |
| 5,979,134 | A | | 11/1999 | Neff | |
| 5,983,582 | A | * | 11/1999 | Vugrek | 52/263 |
| 5,992,111 | A | | 11/1999 | Waterhouse | |
| 6,044,610 | A | | 4/2000 | DeVon et al. | |
| 6,128,880 | A | * | 10/2000 | Meenan, Jr. | 52/489.1 |
| 6,550,195 | B1 | | 4/2003 | Cooper et al. | |
| 6,637,161 | B1 | | 10/2003 | Buchalter et al. | |
| 6,694,691 | B2 | | 2/2004 | Ku | |
| 6,755,001 | B2 | | 6/2004 | Eaton | |
| 2002/0003194 | A1 | | 1/2002 | Simmons | |
| 2002/0005022 | A1 | | 1/2002 | Matthews | |
| 2003/0192268 | A1 | | 10/2003 | Zaborowski | |

* cited by examiner

STRUCTURALLY INTEGRATED ACCESSIBLE FLOOR SYSTEM

CROSS-REFERENCE TO RELATED APPLICATION

This application is a continuation-in-part of U.S. patent application Ser. No. 10/410,934, filed Apr. 9, 2003, which application is a continuation-in-part of U.S. patent application Ser. No. 09/887,772, filed Jun. 21, 2001. Both applications are incorporated herein by reference in their entireties.

BACKGROUND OF THE INVENTION

1. Technical Field

The present invention relates to floor structures in which space below the floor is accessible, and more specifically to an accessible floor structure that is structurally integrated with the associated building structure.

2. Description of the Related Art

The increase in the use of computers, communication devices, and other electronic hardware has placed new demands on building designers. Users desire a large number of outlets for access to electrical power and communication signals, and they need the ability to change the location of such outlets on a regular, sometimes frequent basis. Power and data outlets have been located in, or under, a floor, typically in removable floor sections elevated above the original floor by supports. Two typical types of elevated floors are the pedestal floor and the low-profile floor.

The pedestal access floor has pedestals that consist of metal rods with a base plate at one end and a supporting plate on the other that supports removable horizontal panels, thus forming a raised floor structure. The metal rods are height adjustable and rest on a conventional solid floor deck. The solid floor deck may be made of wood, concrete, or a combination of metal deck and a concrete topping slab. The rods are arranged in a grid, typically square. The rods and plates support removable floor sections. The height of the rods is typically about 12 to 18 inches and can be adjusted to a desired height prior to installing the floor sections. Electrical power and data cables are laid between the solid floor deck and the underside of the floor sections. The cables penetrate the floor sections at a desired location to suit the user's needs. The penetrations may consist only of openings for cables, or may be junction boxes, similar to common electrical wall outlets. The penetrations may accommodate power wires, or signal cables such as cable television, speaker wire, computer networks, etc. In some designs, the space between the floor deck and the elevated floor sections is configured to enable the distribution of conditioned air through grilles and/or registers located in selected floor sections. A flooring system of the type described above is disclosed in U.S. Pat. No. 3,396,501, issued to D. L. Tate on Aug. 13, 1968.

There is a labor premium involved in having to locate and install the foregoing pedestal system. The pedestals must be braced to meet seismic code, further increasing labor and material costs. Moreover, the pedestals increase ceiling height requirements, and ultimately the height of the building, especially if the building has many stories, which increases the area of the exterior envelope, thereby increasing not only construction costs but also operating costs due to heat loss. If the pedestal access floor is only used in parts of a building, ramps or structural accommodations must be made for the changes in floor elevation. As users re-route electrical cables below the access floor, the pedestals may present an impediment in pulling cables to a new location. The access floor also represents another step in the construction schedule. The acoustical properties of this system are poor. The floor panels are usually relatively thin, and transmit sound both horizontally and vertically.

A second type of elevated floor is a low-profile design, which may be roughly 2½ inches to 4 inches high. This design does not use pedestals to raise and support the floor sections, but rather relies on "feet" at the corners of the sections to create the space above the solid floor deck and below the underside of the panel. The panels, with low "feet," rest directly on the floor deck. This low-profile design is less costly than the pedestal floor, but still impacts the cost of a traditionally designed floor in a building because it requires the use of a solid floor deck. The problem of elevation changes between the existing conventional floor and accessible floor also remains. It may also increase the floor-to-floor height of a multi-story building, albeit less than a traditional pedestal floor.

There are also disadvantages to the low-profile floor compared to the pedestal floor. The space below the low-profile sections is not deep enough to be used to supply air. The resulting floor is not as stable, in either the horizontal or vertical dimension, as the pedestal access floor described above. Since the sections are not fastened to the floor deck, they can move when cable is being pulled and re-routed. In general, the smaller distance between the solid floor deck and the surface of the floor sections decreases the flexibility of the low-profile floor. Both types require an underlying solid floor deck for support, and to provide structural stability to the overall building structure.

In addition, the acoustical characteristics of both common types of elevated floors are typically very poor. They tend to transmit noise to a degree that makes them impractical for use in many environments.

Another type of accessible floor is disclosed in U.S. Pat. No. 3,583,121, issued to D. L. Tate on Jun. 8, 1971. This system includes two layers of bar joists laid one on top of the other at right angles thereto. Panels laid over the upper layer may be configured to be removable, to provide access to space underneath. One disadvantage of this system is the height of the two layers of joists and the added height this imparts to a building. Additionally, the joists must be laid at least as closely together as the width of the panels. The resulting weight and depth of the system is too great to be practical except where particularly heavy loads are imposed on the floor. Also, the joists have to be welded at each intersection greatly increasing field labor costs.

BRIEF SUMMARY

In accordance with an embodiment, a floor assembly for a building is provided, the floor assembly having a plurality of primary structural building members, a plurality of spaced-apart secondary structural building members spanning the primary building members, a support grid on the top surfaces of and rigidly coupled to the secondary building members, and a plurality of panels mounted on the support grid to form the floor, with each of the panels individually removable from the support grid to provide access to the space beneath.

According to another embodiment, a prefabricated grid section is provided, configured to receive a plurality of removable floor panels on an upper surface. The grid section is configured to be rigidly coupled between adjacent framing members of a building and to support a selected floor load. The grid section also has sufficient strength and rigidity to be moved into position and coupled to the framing members of the building as a single preassembled unit. According to an embodiment, the grid section is sized to be transported to a location of the building as an assembled unit.

According to an embodiment, a plurality of prefabricated grid sections are rigidly coupled to each other and to framing members of the building to comprise a structurally integrated floor. According to an embodiment, the floor is configured to function as a building diaphragm.

According to an embodiment, a subfloor deck is provided, that is coupled below an accessible floor and that includes area that is substantially unobstructed by structural elements of the floor. According to an embodiment, the subfloor deck is configured to function as a building diaphragm.

BRIEF DESCRIPTION OF THE SEVERAL VIEWS OF THE DRAWING(S)

DETAILED DESCRIPTION OF THE INVENTION

Figure 1:
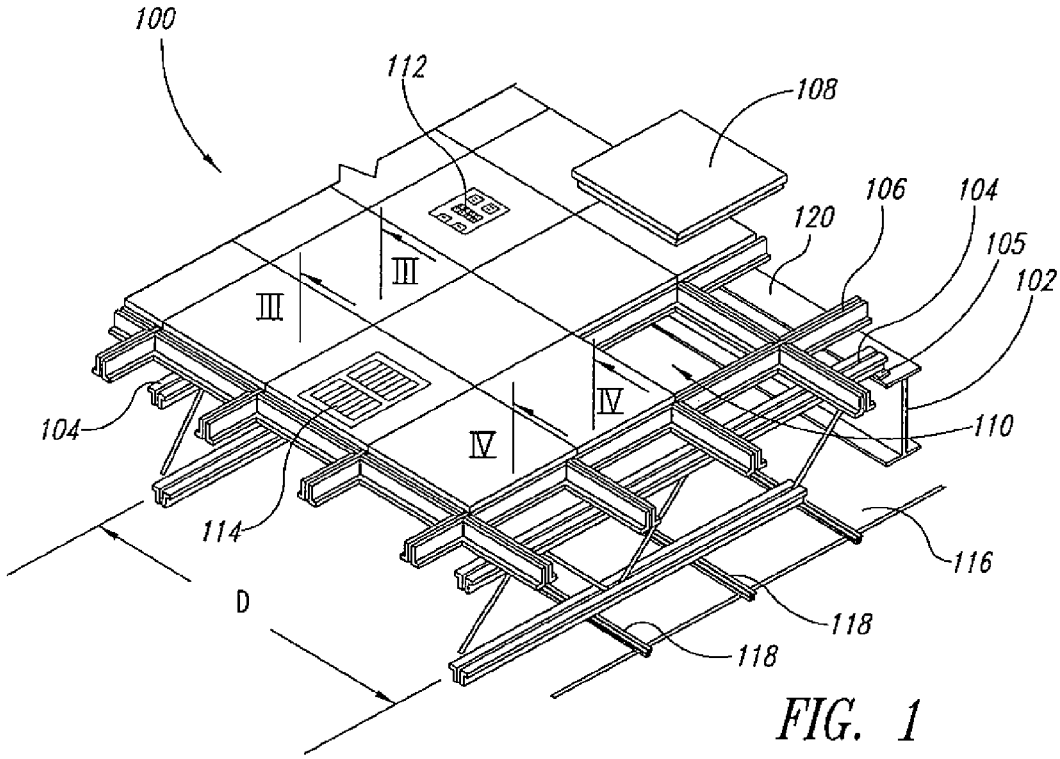
FIG. 1 shows an isometric view of a section of the floor system formed in accordance with one embodiment.

The structural elements of a building comprise the columns, girders, beams, trusses, joists, braced frames, moment resistant frames, vertical and lateral resisting elements, and other framing members that are designed to carry portions of the dead or live load and lateral forces, and that are essential to the stability of the building. The term framing member is used in the specification and claims to refer to vertical and horizontal structural elements that comprise portions of the frame of a building.

According to various embodiments, structurally integrated accessible floor systems are provided. Such systems provide access to space beneath the floor surface, typically by the use of removable panels. They are configured to be integrated with the structural frame of a building in a manner similar to a conventional floor, and in some embodiments serve to transmit lateral forces as well as acting as load bearing surfaces. They differ significantly from conventional accessible floor systems in that they are not configured to be supported by a solid floor deck, with or without pedestals. A prior art accessible floor that is configured to be supported below by a separate floor surface is not a structurally integrated system, nor is it capable of integration with a building structure, as the term is used herein.

According to a first embodiment, a structurally integrated accessible floor system, hereinafter referred to as the floor system, is designated generally as 100, and is shown isometrically in FIG. 1.

Primary framing members 102 are provided, which are integral parts of metal frame type buildings. Secondary framing members, such as joists 104 are connected to the primary framing members 102, typically by welding or riveting, although fasteners of various kinds, which are well known in the art, can be used. According to one embodiment of the invention, a structural support grid 106 is then formed, bearing on the secondary framing members 104. The grid 106 is configured to receive removable floor panels 108 in the openings 110 formed by the grid 106.

The grid 106 is configured to span across the secondary framing members 104 such that a plurality of floor panels 108 are supported by the grid between each secondary framing member 104, without the need for support by a secondary framing member for each floor panel 108. For example, the grid 106 is shown in FIG. 1 spanning across a distance D between two secondary framing members 104 while supporting the width of three panels 108 in that same distance. This is in contrast to conventional removable flooring systems, in which each removable panel is generally supported by a grid having a leg, post, or pedestal at each corner of each panel.

The removable floor panels 108 are of a uniform size to allow interchangeability, and they may be provided with terminals or hookups 112 for electrical power and communication access, and with vents or registers 114 for ventilation.

For the sake of convenience and clarity, one type of power terminal 112 is shown in FIG. 1. However, it will be obvious to those skilled in the art that a wide variety of terminals may be used, including standard 110 volt sockets, coaxial cable terminals, fiber optical connections, heavy duty power terminals, T2 connectors, etc. A user may further choose to provide an opening in the panel to enable the passage of cable without the use of a terminal. These and other options are considered to be within the scope of the invention.

By the same token, a wide variety of means to transmit air and gas may be used in place of the vent 114, including compressed air hookups, vacuum lines, fans, directionally adjustable vents, filters, emergency gas evacuation systems, compressed oxygen, $CO_2$, propane, nitrogen, etc.

FIG. 1 also shows optional panels 116 attached to metal channels 118, which are in turn affixed to the underside of the secondary framing members. These panels 116 are ideally constructed of material that resists fire, thus forming a fire block. The panels 116 isolate one story of a building from the next, establishing fire protection, which may be required by many building codes. The panels 116 attached to the underside of the secondary framing members enclose the space between the secondary framing members. This enclosed space may be employed as a plenum for HVAC. This can result in a financial savings, because ductwork is reduced or eliminated. Partitions may be used within this space to permit discreet sections of the floor system to pressurize for use as a plenum.

Figure 2:
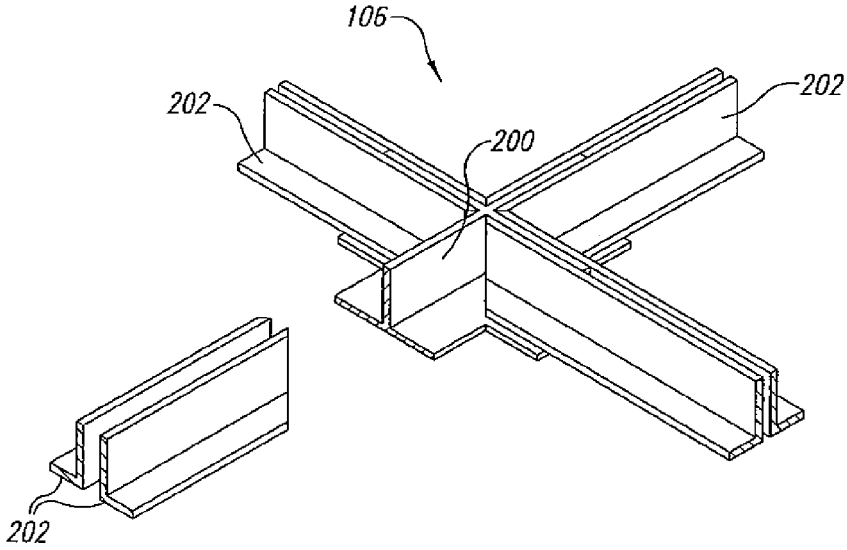
FIG. 2 shows a detail of a structural support grid element of a floor system formed in accordance with another embodiment.

Referring next to FIG. 2, shown therein is a section of one embodiment of the structural support grid 106. According to this embodiment, the structural support grid comprises L-shaped rail members 202 affixed in back-to-back relationship to T-shaped joint nodes 200 to form supports for the removable floor panels. The nodes and rail members are standardized to permit interchangeability.

It is to be understood that the rail members may have many different cross-sectional shapes and node configurations. For example, some alternative cross-sectional shapes include channel, "T", and square.

Figure 3:
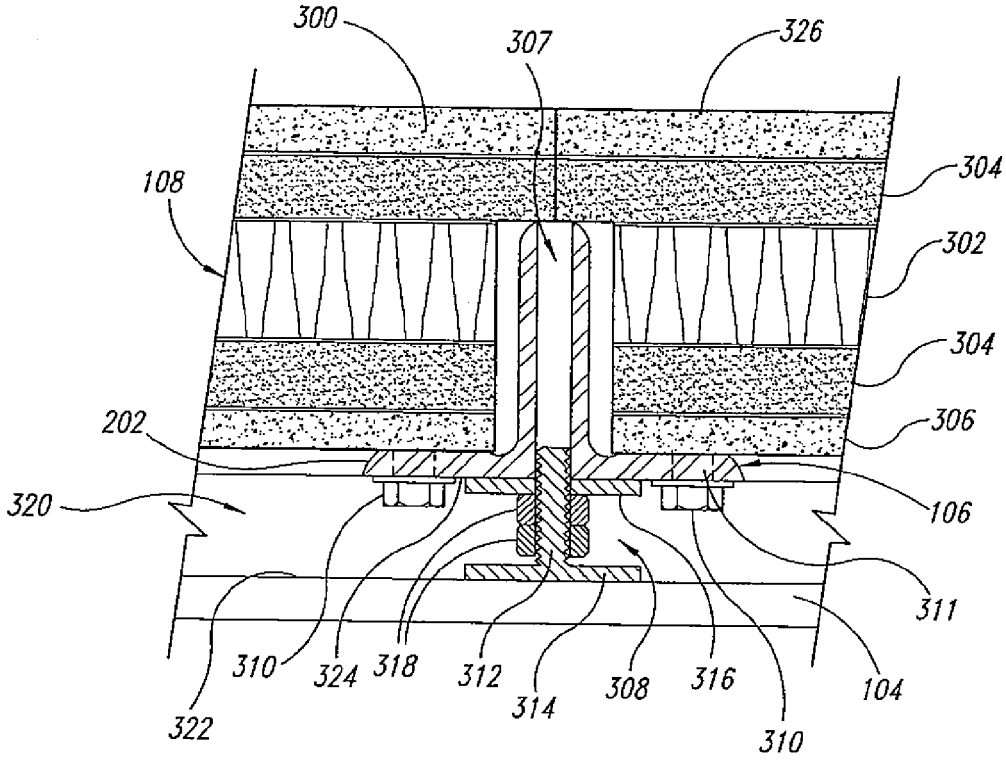
FIG. 3 is a cross-sectional view taken along line III-III of a portion of the floor system of FIG. 1.

FIG. 3 shows the floor system 100 in cross-section taken along lines III-III in FIG. 1. The removable floor panel 108 has a plurality of layers, including a top layer 300, which is configured according to the requirements of the particular application and may have a carpeted surface or a tile surface. Alternatively, the top surface 326 may be formed using chemically resistive materials for use in a lab or other caustic environments. The top layer 300 and a bottom layer 306 are designed to provide structural stiffness to the panel 108 and are configured according to the structural and weight bearing requirements of the particular application. Fire retardant layers 304 may also be structural and are composed of fire resistant materials such as gypsum, or other appropriate material, and serve to inhibit the passage of fire from one side of the panel 108 to the other. An insulation layer 302 provides thermal and acoustic insulation, and may be slightly oversized to provide a friction fit in the grid.

It will be understood that the composition of the removable floor panels will vary according to the requirements of a particular application and will in part be dictated by the anticipated environment, the required load carrying capacity, the desired appearance, the anticipated degree of noise control, local building and fire codes, and other factors.

Although the removable floor panels 108 bear against the structural support grid 106, panel fasteners 310 may be used to positively attach the panels 108 to the structural support grid 106. In the embodiment shown in FIG. 3, the panel fasteners 310 comprise threaded fasteners that pass from a lower surface of the structural support grid 106 into an opening in a lower surface of the removable panel 108 via an opening 311 in the rail member 202 of the structural support grid 106. The opening 311 is oversized in relation to the threaded fastener 310 to enable adjustment in the position of the removable panel 108 relative to the structural support grid 106. The threads of the threaded fastener 310 engage the removable panel and a hexagonal head of the fastener 310 bears against the lower surface 324 of the support grid 106, drawing the removable panel tight against the structural support grid 106. Thus, in this embodiment access to the panel fasteners 310 is from beneath the structural support grid 106.

According to one embodiment, the structural support grid 106 is welded or otherwise rigidly fastened to the secondary framing members 104. According to another embodiment, a leveling unit 308 is provided to control a vertical distance 320 between the structural support grid 106 and the secondary framing members 104. FIG. 3 shows one of a plurality of similar units that comprise the leveling system, which functions as described below.

As shown in FIG. 3, the leveling unit 308 includes a threaded rod 312 attached to a support plate 314 that bears against or is welded to an upper surface 322 of the secondary framing member 104. The threaded rod 312 passes through a lift plate 316 via an opening in the lift plate 316, with the lift plate 316 bearing upward against the lower surface 324 of the structural support grid 106. The rod 312 is slideably received in an opening 307 formed in the grid 106. A pair of jam nuts 318 on the threaded rod supports the lift plate 316. The position of the jam nuts 318 on the threaded rod determines the distance 320 between the upper surface 322 of the secondary framing member 104 and the lower surface 324 of the structural support grid 106.

By adjusting each of the plurality of units of the leveling system, the bearing surface 326 of the floor system 100 can be leveled, even if the upper surfaces 322 of the secondary framing members are not level.

In another embodiment of the invention, leveling devices that are functionally similar to the leveling unit 308 described above may be employed between an upper surface 120 (shown in FIG. 1) of the primary framing members 102 and the part of the secondary framing members 104 that bears against the primary framing members. By adjusting the vertical distance between the primary and secondary framing members, the level of the structural support grid 106 can be controlled. Alternatively, shims 105 can be used to level the secondary framing members. Once leveled, the secondary framing members 104, the shims, 105, and the primary framing members 102 can be welded together to form a rigid connection.

Other methods of controlling the vertical distance (not shown) between the primary and secondary framing members 102, 104, or between the structural support grid 106 and the secondary framing members 104 will be obvious to those skilled in the art. These methods include the use of wedges, threaded devices that are accessed from above the floor system, automatic or remotely adjustable devices, etc., all of which are deemed to be within the scope of the invention.

Figure 4:
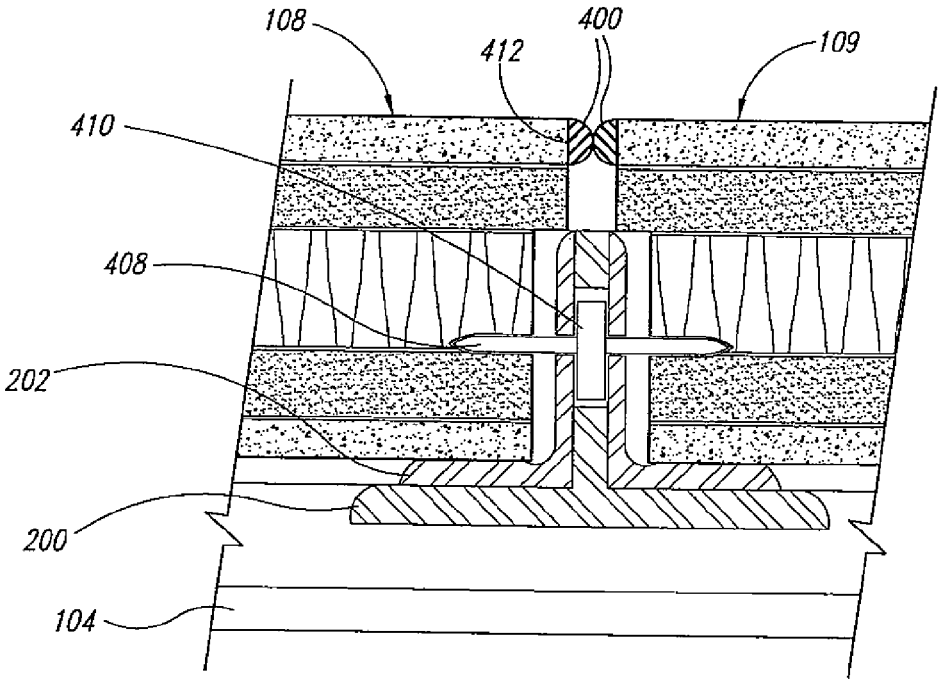
FIG. 4 is a cross-sectional illustration of an alternative embodiment of the floor system of FIG. 3 taken along line IV-IV.

FIG. 4 is a cross-sectional view of a floor system 100, taken along line IV-IV, and shows an alternative embodiment of the removable panel 108. In this embodiment, a flexible gasket 400 is affixed to the top edge 412 of each panel 108, 109. The gaskets 400 of adjoining panels 108, 109 press against each other, providing a seal between the removable panels 108, 109. The seal may be employed to prevent spills from leaking through the floor system. In applications where spills of caustic or dangerous fluids might be anticipated, the composition of the gasket 400 is chosen to be resistant to the particular classes of substances in use. Multiple or interlocking gaskets may also be employed to provide a more secure seal. Alternatively, a single gasket may be wedged between the adjoining panels 108, 109 after they are installed on the structural support grid 106. The gasket 400 may also be used in applications where it is desirable to control the movement of air or other gasses from one side of the floor system to the other.

FIG. 4 also shows an alternative embodiment of the panel fasteners. Here, the panel fastener 410 is accessed with a tool (not shown) that is inserted from above the surface of the floor system into the center of the joint node 200. The panel fastener 410 is rotated approximately 45°. Fastener blades 408 rotate from positions in slots (not shown) in the joint node 200 into slots in the corners of the removable panels 406, locking them in place.

Other locking devices and systems will be evident to those skilled in the art and are considered to be within the scope of the invention. Such devices include those employing cam-type fasteners, devices that are accessible from the surface of the removable floor panels, devices that latch automatically when the removable floor panels are emplaced, etc.

Depending upon the height and local requirements, some buildings include devices or methods of construction that provide earthquake resistance. In conventional construction methods a solid floor deck functions as a diaphragm, which is resistant to dimensional stresses. As will be discussed later, elements of a structurally integrated floor system can, according to various embodiments, function as a diaphragm.

Figure 5:
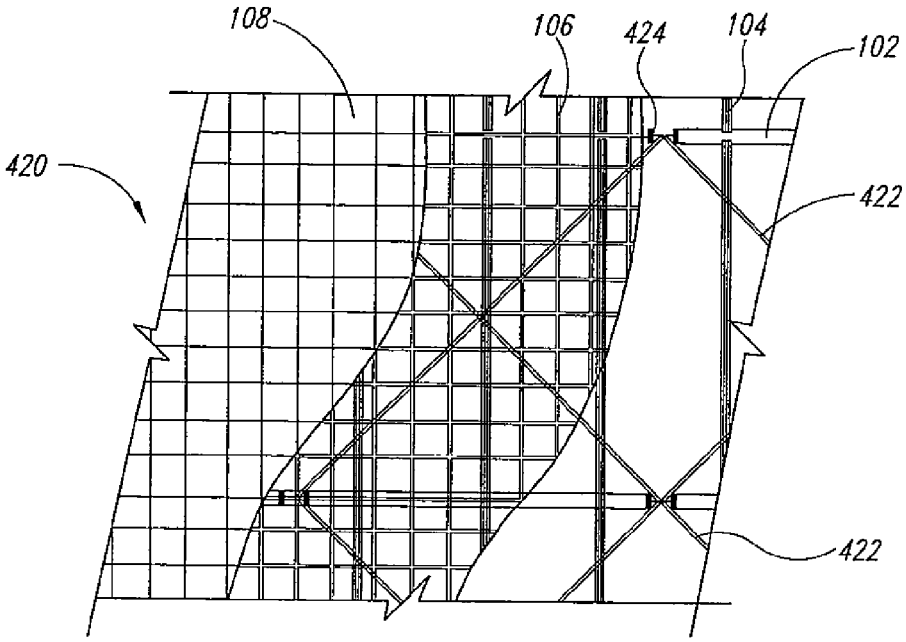
FIG. 5 is a plan view of a floor system according to another embodiment.

According to one embodiment, and as illustrated in FIG. 5, the structural support grid 106 is attached orthogonally, relative to the primary 102 and secondary 104 framing members. Diagonal stays 422 are employed to brace and provide the requisite stability to the structure. The stays 422 are attached directly to the columns 424 of a building and pass underneath the floor structure 420.

Figure 6:
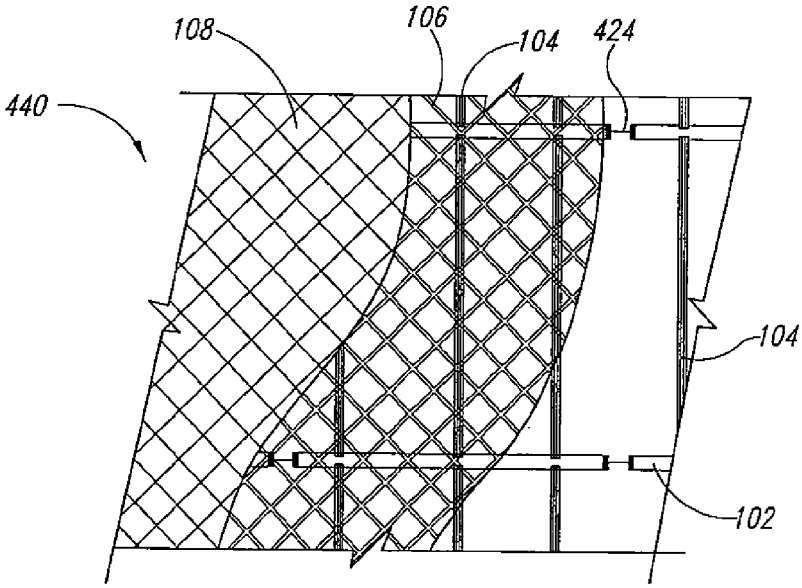
FIG. 6 is a plan view of a floor system according to an alternative embodiment.

FIG. 6 shows floor structure 440 according to an alternative embodiment, in which the structural support grid 106 is oriented diagonally, relative to the primary 102 and secondary 104 framing members. In this embodiment, the structural support grid 106 itself forms the diagonal bracing that reinforces the building structure.

Figure 7:
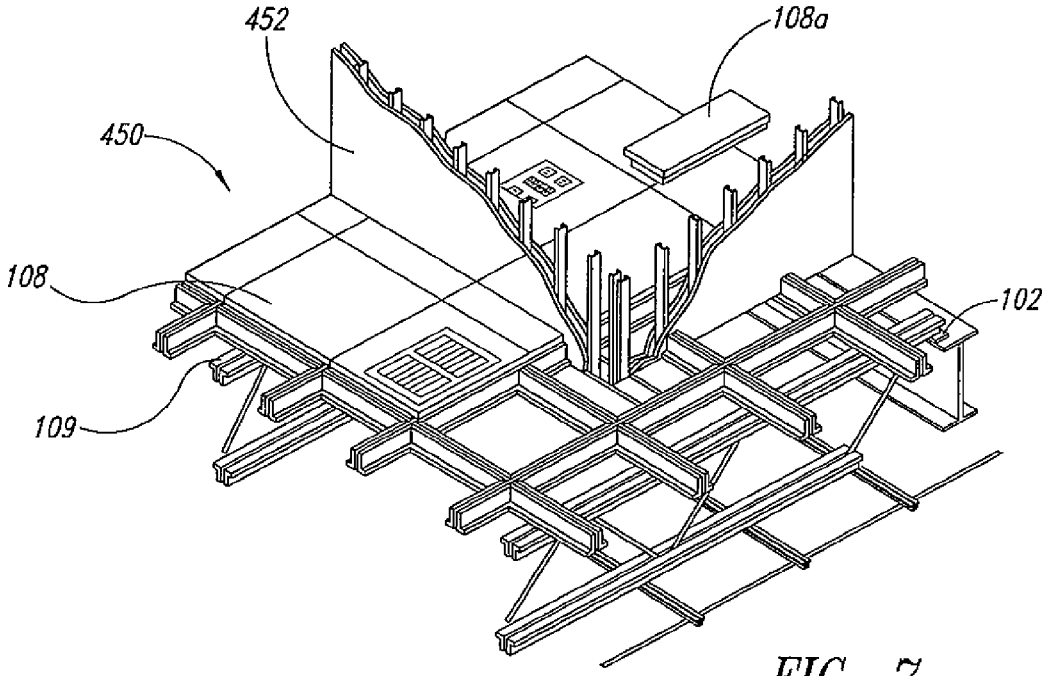
FIG. 7 is an isometric view of a further embodiment of a floor system.

In a further embodiment, as shown in FIG. 7, repositionable walls 452 are employed as part of the structurally integrated accessible floor system 450. These repositionable walls can comprise floor to ceiling room dividers that are assembled on site, as shown in FIG. 7, or prefabricated and installed as individual units, or alternatively they may be prefabricated cubicle dividers of the type common in office environments. The repositionable walls 452 are affixed directly to the structural support grid 104. Partial floor panels 108*a* may be cut to the necessary size at the site, using conventional methods, or may be manufactured in common dimensions. By affixing the walls 452 to the grid 106 and employing partial floor panels, acoustical isolation is enhanced and the structural stability of the walls 452 is improved.

Electrical components in the walls 452, such as light switches, thermostats, power connections etc, can be wired directly through the bottom of the walls via harnesses (not shown) connected to cables and connectors underneath the floor panels 108. This is a significant advantage, especially in the case of cubicle dividers, over the methods currently in use, because conventional cubicle dividers must bring power into open areas and may involve complex interconnections between the dividers, and power drops from ceilings. Other methods include the use of wireless technology for switches and controls. Such technology has the advantage that it doesn't require any wiring connections in the walls.

Figure 8:
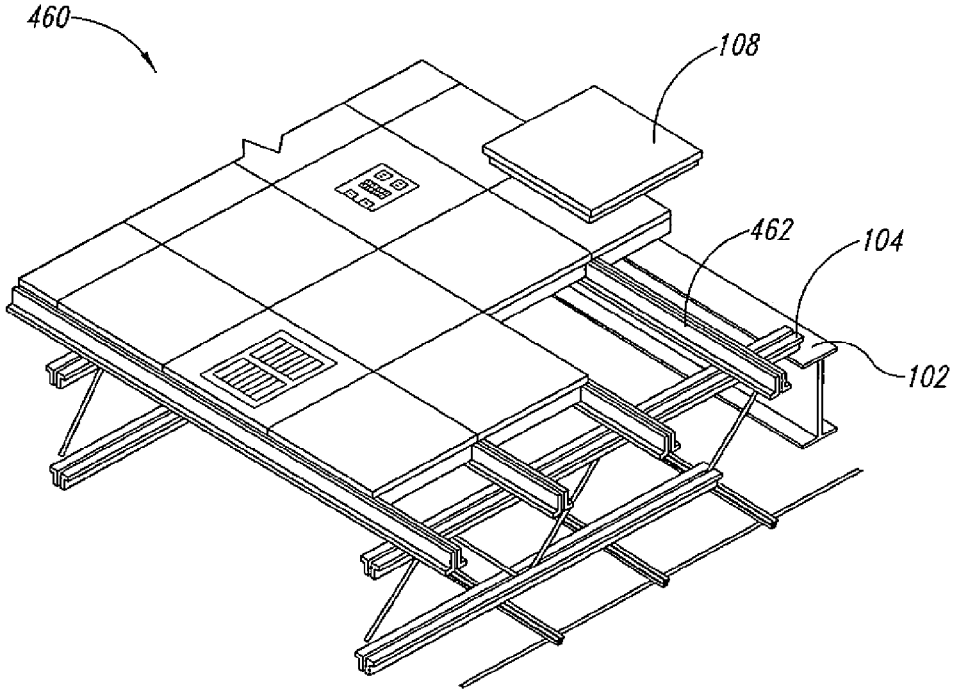
FIG. 8 is an isometric view of a floor system illustrating an alternative embodiment.

FIG. 8 illustrates an alternative embodiment 460 of the invention in which structural support rails 462 are employed. The rails 462 span the secondary framing members 104 and support the removable floor panels 108 on two sides. The floor panels 108 of this embodiment are configured to have sufficient rigidity to span the space between the structural support rails 462 without the additional support of cross rails or bracing.

Figure 9:
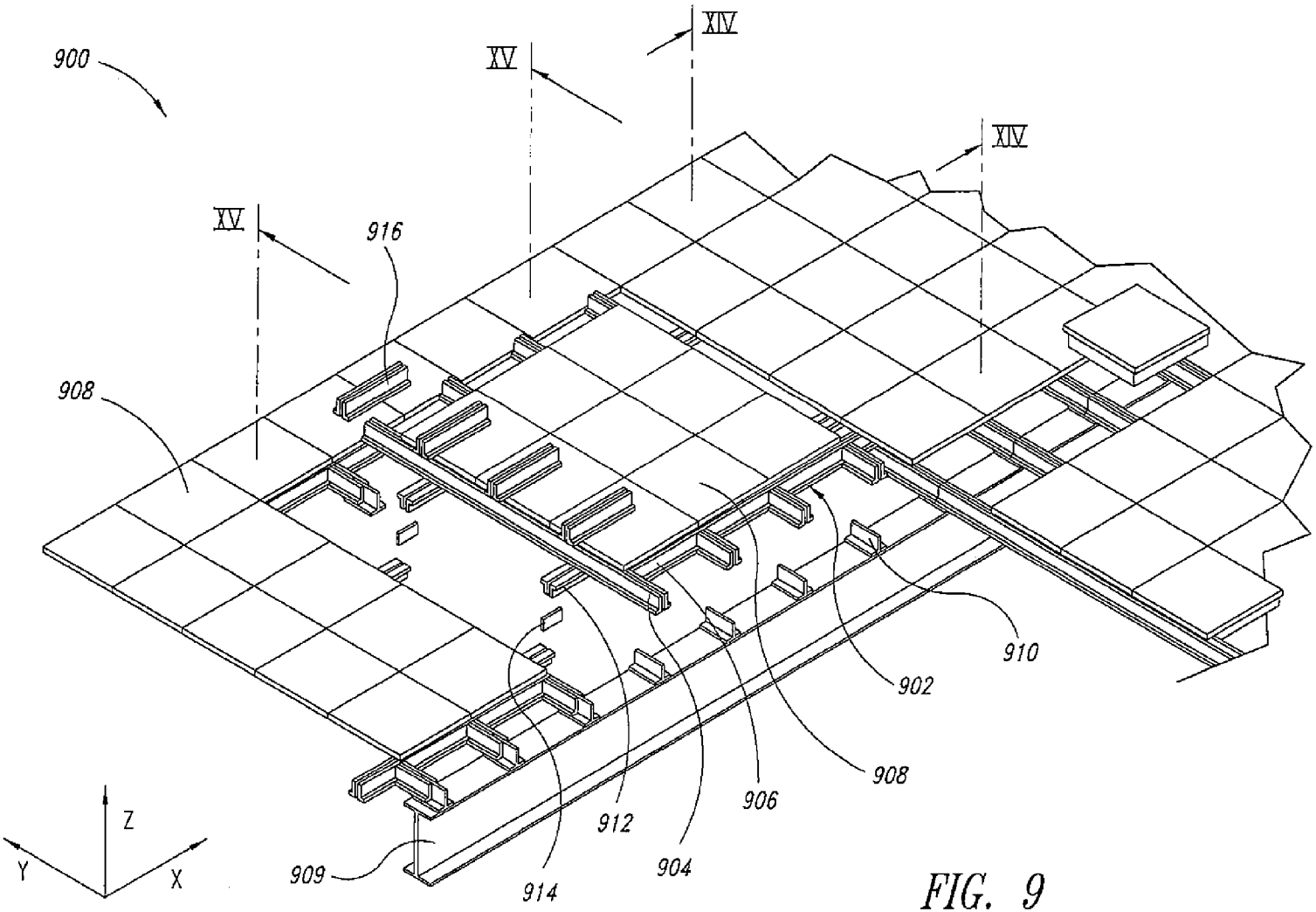
FIG. 9 is a partially exploded view of a flooring system according to another embodiment.

Another embodiment of the invention is described with reference to FIGS. 9-15. A floor system 900 is shown in FIG. 9 as part of a building structure. The system 900 includes a prefabricated floor section 902 having a first plurality of support rails 904. Each of the support rails 904 includes a pair of spaced-apart angle members running the full length of the section 902. Cross-support rails 906 are positioned at regular intervals between the support rails 904, each adjacent pair of support rails 904 and cross-support rails 906 forming an opening configured to receive a removable floor panel 908 therein.

Figure 10:
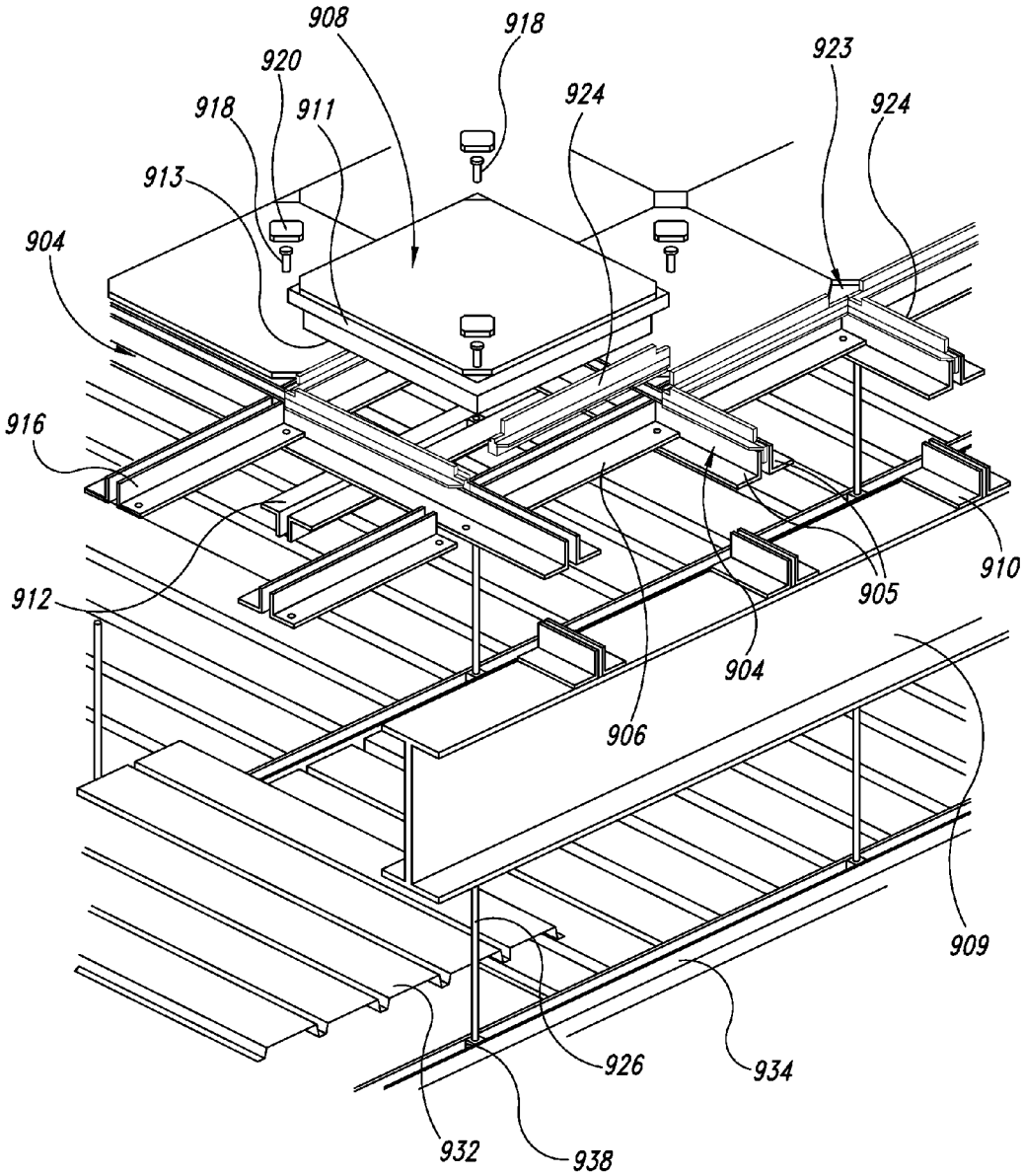
FIG. 10 is a more detailed view of the system of the embodiment of FIG. 9.

The prefabricated floor section 902 is configured to span secondary framing members 909 of the structure. Connectors 910 are affixed to an upper surface of the secondary framing members 909 in a regularly spaced relationship, corresponding to the spacing of the support rails 904 of the prefabricated section 902. The connectors 910 may be affixed to the upper surface of the secondary framing member 909 by any appropriate method, including welding, bolting, etc. FIG. 10 shows each connector 910 as comprising a pair of angle sections in a spaced-apart relationship. It will be understood that the connector 910 may be formed from a single T-shaped member or some other structure that provides the necessary spacing and support for the support rail 904. The spaced-apart angle members 905 of each support rail 904 engage the connector 910 to provide positive contact between the prefabricated section 902 and the secondary framing member 909. Before being attached to the connectors, the vertical position of each support rail can be adjusted so as to level the floor section 902 relative to the framing members 909. The support rails 904 are affixed to the connectors 910 by a known method such as welding or bolting. Alternatively, some of the support rails 904 of the prefabricated section 902 may be affixed to their respective connectors 910, while others of the support rails 904 may be allowed to rest directly on the connector 910 without being positively affixed thereto, or to extend over the framing members without making any contact with the respective support rails 904. The connectors 910 may be preaffixed to the secondary framing member 909 prior to erection of the structure. For example, the secondary support member 909 may have the connectors 910 affixed thereto at a fabricating plant prior to shipment to a construction site.

Figure 11:
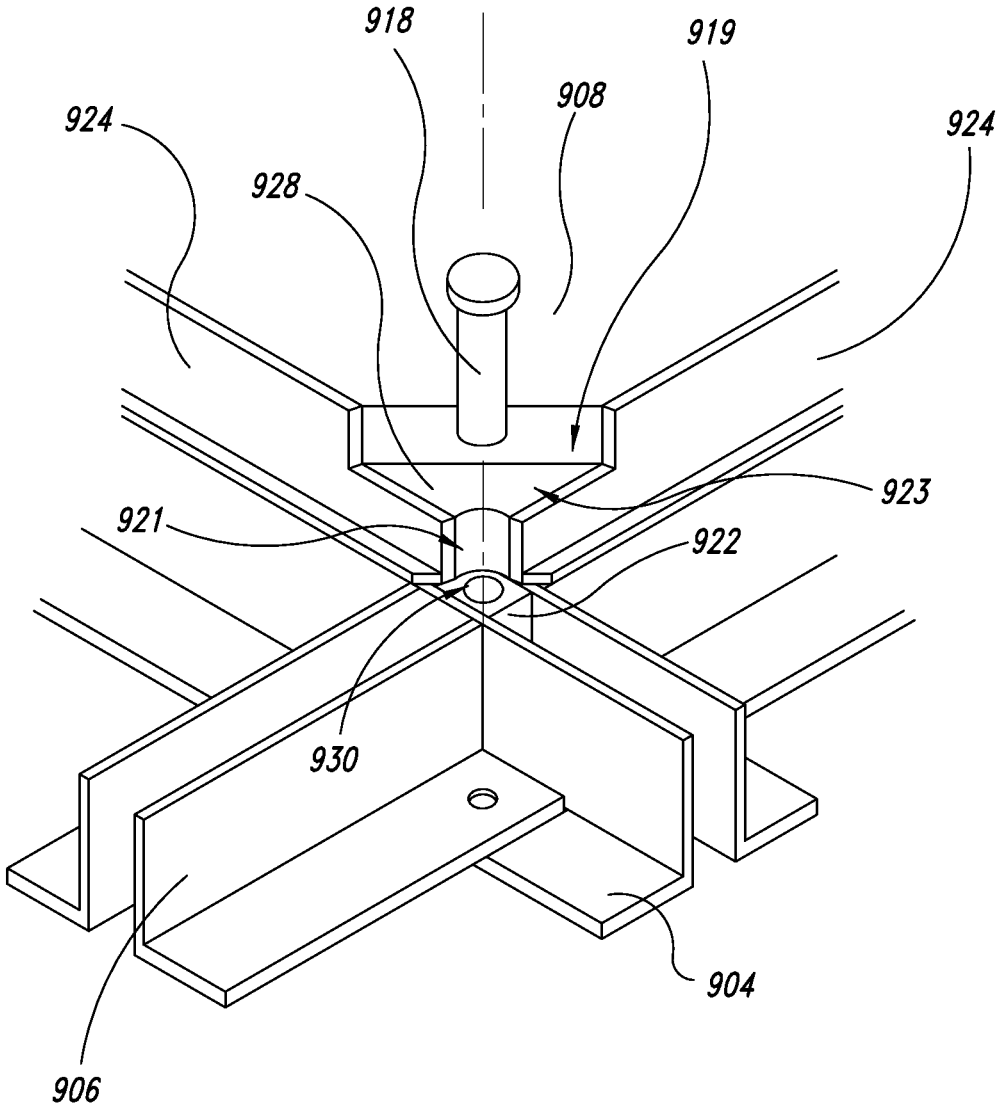
FIG. 11 shows a detailed view of a feature of the embodiment of FIG. 9.
Figure 12:
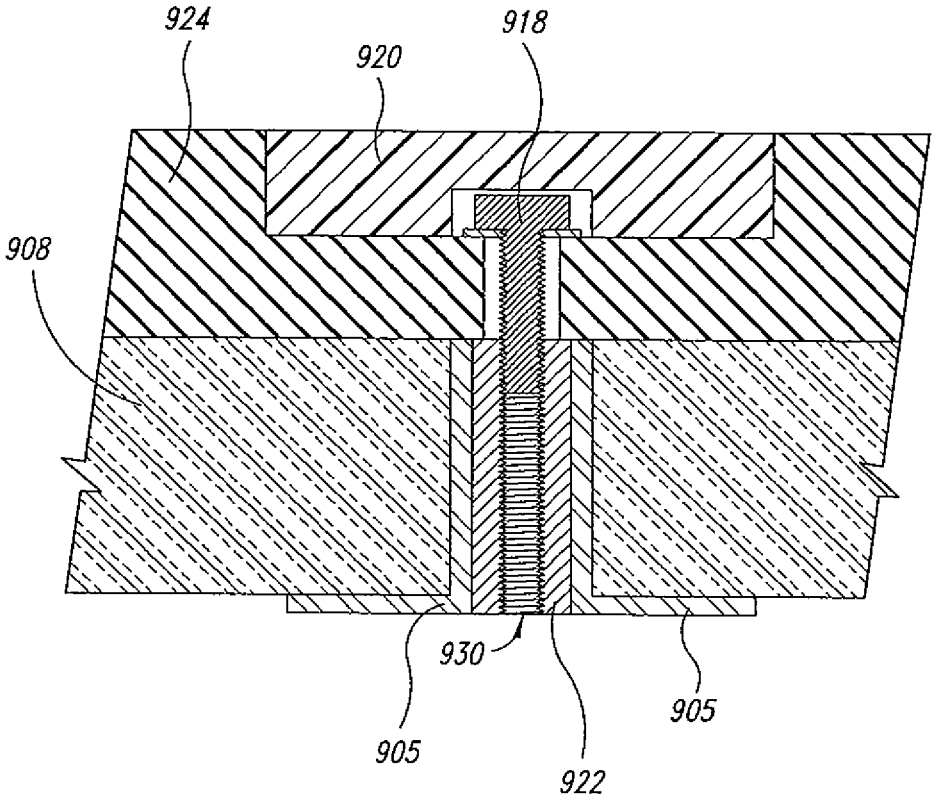
FIG. 12 is a cross sectional view of the portion of FIG. 10 indicated at lines XII-XII.
Figure 13:
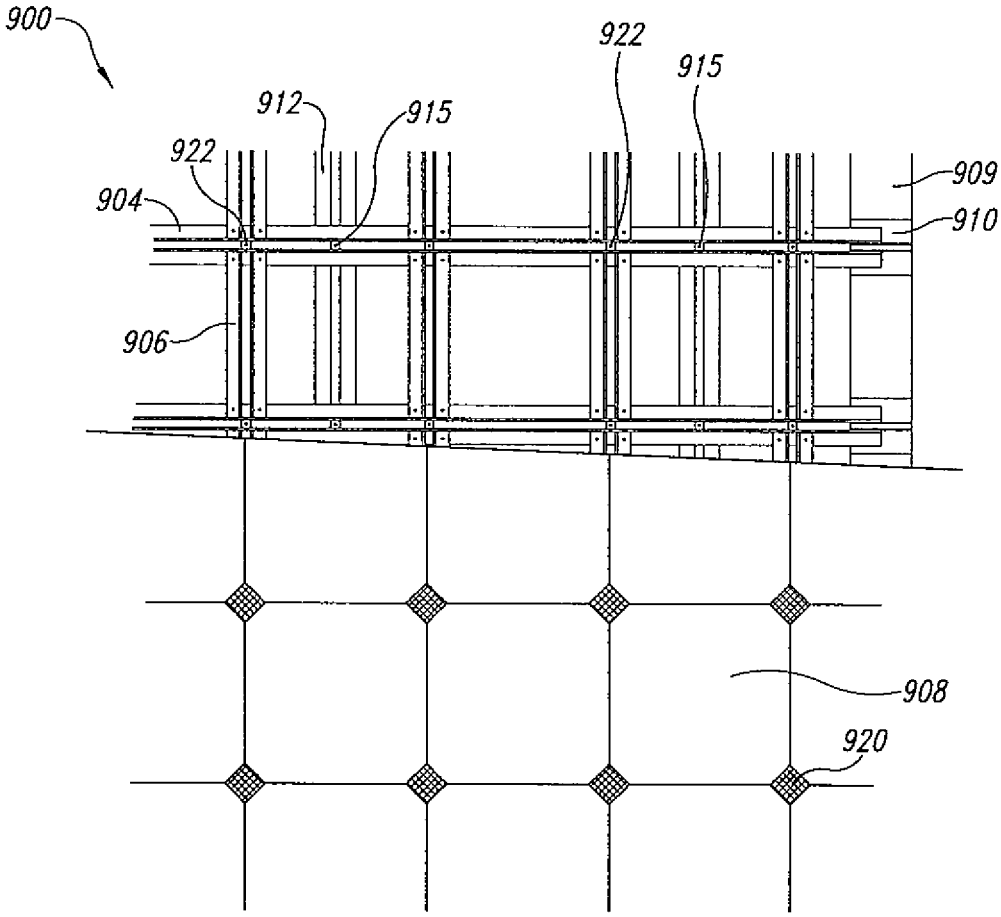
FIG. 13 is a partial cut-away plan view of the system of FIG. 9.

Spacers 922 are positioned and affixed between the spaced apart angle members 905 of each of the support rails 904. The spacers 922 maintain the spaced apart relationship of the angle members 905 in the embodiment shown, the spacer is illustrated as a section of square rod positioned between the angle members 905. FIGS. 10-12 show the spacers 922 having threaded holes passing therethrough, and positioned in locations corresponding to the positions of the cross rails 906.

The prefabricated section 902 includes subfloor rails 912 affixed to the underside of the prefabricated section 902 at right angles to the support rails 904. In the embodiment shown in FIGS. 9-15, the subfloor rails 912 comprise spaced-apart angle members 917 similar to those of the support rails 904, with square spacers 915 affixed between the angle members 917. The subfloor rails 912 run the entire width of the prefabricated section 902, and are positioned such, that the subfloor rails 912 of adjoining prefabricated sections 902 meet in an end-to-end configuration. Splice plates 914 affixed between subfloor rails 912 of adjoining sections 902 join the subfloor rails of adjoining sections 902 together. By aligning and joining subfloor rails 912 of adjacent sections 902 together, correct positioning and spacing of adjacent prefabricated sections 902 is assured. Secondary cross rails 916 are positioned in a spaced apart relationship between adjacent sections 902 in positions corresponding to the cross rails 906 of the prefabricated floor sections 902 to provide support for removable floor panels 908 to be placed between adjacent prefabricated panels 902.

Gaskets 924 of resilient or semi-resilient material are positioned between the floor panels 908. The gaskets 924 may be configured to improve the sound dampening characteristics of the floor system 900. The gaskets 924 may also be configured to provide a seal between adjacent floor panels 908, configured to prevent the passage of liquids or gasses therethrough. They may be formed from material that is heat or fire resistant, to provide improved fire protection. In FIG. 10, the gasket 924 may be seen to have a modified T-shape in cross-section, with a lower portion sized and configured to fit snugly between the spaced apart angle members 905 of the support rails 904, and the cross rails 906. The gaskets further include flanges extending to the sides and configured to receive the upper portions 911 of the floor panels 908 thereon. An upwardly extending portion of the gasket 924 rises between two adjacent floor panels 908 to terminate at a height approximately flush with an upper surface of the floor panels.

As disclosed in previous embodiments of the invention, the removable floor panel 908 includes an upper portion 911 having dimensions that are greater than a lower portion 913, such that, when a floor panel 908 is appropriately positioned between support rails 904 on two sides and cross rails 906 on two sides, the lower portion 913 of the floor panel 908 lies between the upright portions of the support rails 904 and cross rails 906, while the upper portion 911 of the panel 908 extends over the support rails 904 and cross rails 906. Typically, the floor panels 908 are configured to rest on the flanges of the gaskets 924, with the upper surface of the support and cross rails 904, 906 bearing the weight of the panels 908 and any load thereon. Such an arrangement ensures a good seal between the panel 908 and the flange 924. The lower portion 913 of the panels may comprise insulation and fire retardant material. The lower portion 913 of the floor panels 908 may be sized and configured to have a very snug fit in the space between the rails 904, 906 to provide maximum sound and temperature insulation and fire protection.

Other embodiments may include floor panels configured to bear against lower portions of the support and cross rails, or may even be configured to fit entirely between the support and cross rails, with no part of the panel extending over the rails.

As shown in FIGS. 10 through 12, the floor panels 908 are affixed in position by threaded fasteners 918 that engage threads in the opening 930 of the spacer 922 of the support rails 904. The floor panel 908 includes a fastener recess 919 at each corner thereof (such as a truncated corner). The fastener recess 919 defines a shoulder 928, against which a head of the threaded fastener 918 bears to maintain the floor panel 908 in position. A fastener 918 is provided at each corner of the floor panel 908, and each fastener 918 bears against the shoulders 928 of four adjoining removable panels 908. Accordingly, the fastener recesses 919 of four adjoining removable panels 908 collectively define an aperture 921 to receive the threaded fastener 918 to be secured to the spacer 922 below the floor panels 908 (e.g., FIG. 11 shows a portion of an aperture 921 of one floor panel 908). Moreover, said adjoining fastener recesses 919 of said four adjoining removable panels 908 collectively define an area or cavity 923, as exemplified on FIGS. 10 and 11 (showing a portion of a cavity 923). A fastener recess cap 920 is configured to fit in the cavity 923 of the fastener recesses 919 of said four adjoining floor panels 908, and to cover the respective fastener 918 and to provide a continuous and smooth floor surface, as shown on FIGS. 10, 12, and 13.

Figure 14:
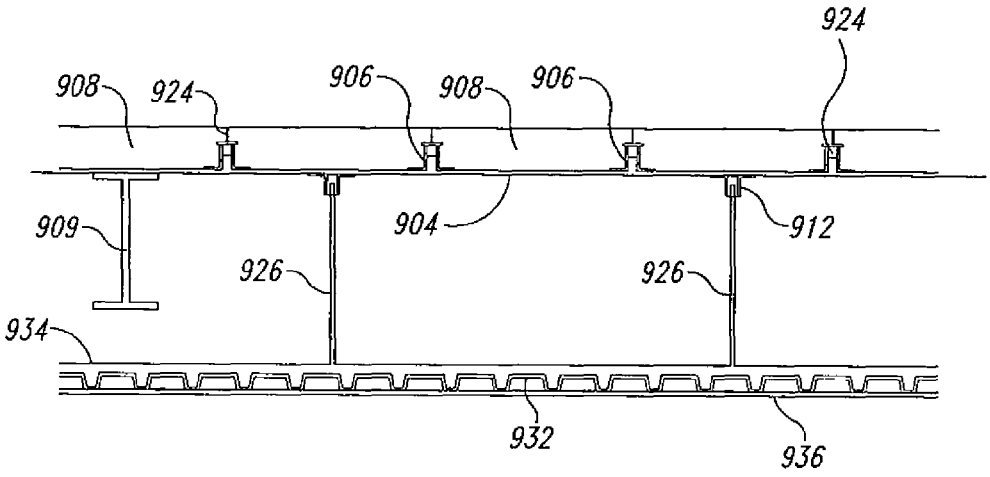
FIG. 14 is a cross sectional view of the portion of FIG. 9 indicated at lines XIV-XIV.
Figure 15:
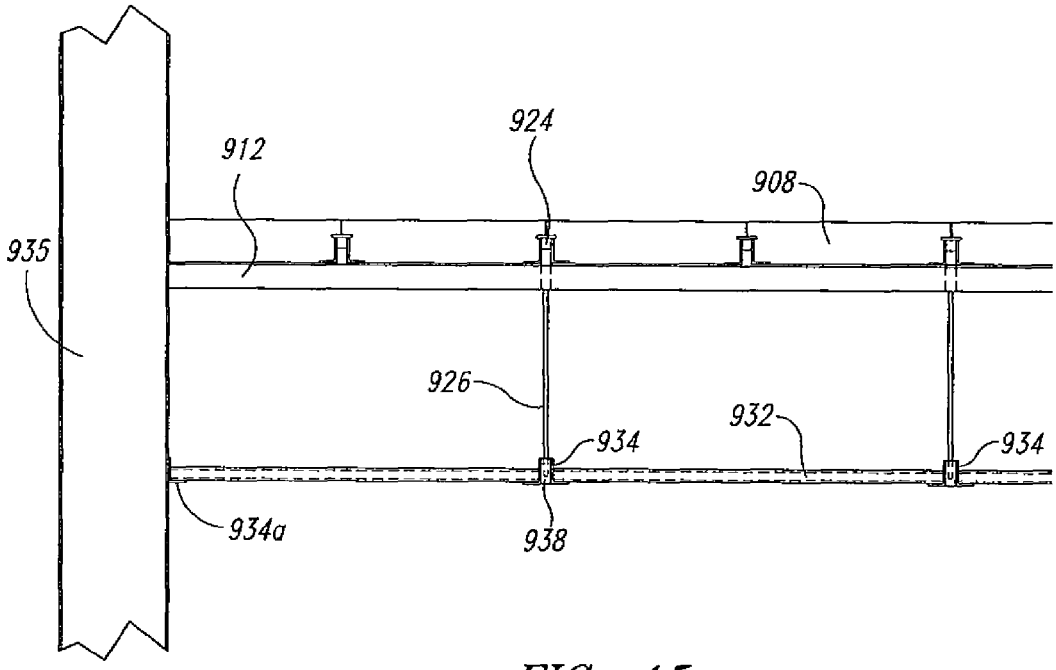
FIG. 15 is a cross sectional view of the portion of FIG. 9 indicated at lines XV-XV.

As shown in FIGS. 10, 14, and 15, the floor system 900 includes deck support rails 934, running generally parallel to the subfloor rails 912, and the secondary framing member 909. The deck support rails 934 include threaded spacers 938, similar to the spacers 922 of the support rails 904. Threaded rods 926 engage the threaded spacers 915 of the subfloor rails 912 at a first end and the threaded spacers 938 of the deck support rails 934 at a second end, supporting the deck support rails 934 a selected distance beneath the section 902. Decking 932, such as, for example, corrugated decking of a type commonly used in commercial construction to support concrete flooring, is placed between deck support rails 934 to form a continuous subfloor deck 933. The deck 933 provides a barrier between floors, preventing passage of fluids and gasses, as well as objects dropped from above. It can also be used for ducting or as part of a plenum enclosure for HVAC.

Suspended ceilings, lighting fixtures, fire control sprinklers, and other utilities for the space beneath the floor system 900 of FIGS. 9-15, such as for a lower story of the structure, can be hung from or affixed to the corrugated decking 932 or to the deck support rails 934. Fire resistant paneling such as gypsum board can also be affixed to the underside of the corrugated decking 936 the deck support rails 934.

In manufacturing and assembling the floor system 900, much of the system can be prefabricated and assembled prior to assembly in a structure. For example, the floor section 902 shown in FIG. 9 is an 8 foot by 8 foot prefabricated section, having 2 foot by 2 foot floor panels 908 installed therein. The prefabricated floor section 902 may include temporary panels, which can be left in place until completion of construction at which time the temporary panels 908 are replaced with finished panels. Use of temporary floor panels prevents damage to the finished panels during construction, and allows construction workers, painters, and finishers to work in floored spaces without the requirement of providing protection for finished flooring. When the temporary panels are removed, they can be reused in subsequent projects, thus providing additional savings to the manufacturer or contractor.

In assembling such a floor system, the secondary framing members 909 are provided with the connectors 910 pre-attached. Each section is lifted into place by a hoist or crane, and lowered onto the connectors 910. Because of the configuration of the connectors 910 and the support rails 904, the floor section 902 is provided with positive positioning in the X-axis.

As shown in FIG. 9, each connector 910 provides positioning for a support rail 904 from each of two adjoining panels 902 in an end-to-end configuration. By drawing the support rails 904 of a section 902 tightly against the ends of the support rails 904 of a previously installed section 902, positive positioning in the Y-axis is assured. After the section 902 is correctly positioned in the X- and Y-axes, the section is leveled through the use of shims or jacks, to bring the section into correct position in the Z-axis. When the section is correctly positioned in the Z-axis, the support rails 904 of the section 902 are affixed to the connectors 910, to lock them permanently in position. This may be achieved by any of several known methods, including welding in place, the use of bolts or rivets passing through the support rails 904 and the connectors 910, or any other acceptable method of attachment.

Next, splice plates 914 are affixed in position between subfloor rails 912 of adjoining sections 902, secondary cross rails 916 are then positioned and affixed to adjoining sections 902, and removable floor panels 908 are placed in the spaces created thereby, between adjoining sections 902. Threaded fasteners 918 and fastener recess caps 920 are installed as necessary to secure the removable floor panels 908. From underneath the floor panels 902, threaded rods 926 are affixed to the threaded spacers 915 of the subfloor rails 912, and to the threaded spacers 938 of the deck support rails 934. Decking 932 is then laid between the deck support rails 934 to form the continuous subfloor deck 933 and enclose a space under the floor system 900. The decking 932 can be affixed to the support rails 934 by any appropriate means, including adhesives, rivets, welding, threaded fasteners, and snap-in connections.

Referring to FIG. 15, a single-sided support rail **934*a* is coupled to a primary framing member 935 of the building, by welding or some other acceptable means, and serves to support a periphery of the decking 932 and couple the subfloor deck to the framing member. With the subfloor deck 933** attached around its perimeter to the building frame, the subfloor deck can be configured to function as a building diaphragm.

The total height H of the floor system 900 (see FIG. 14) above the surface of the secondary framing members is selected to be approximately equal to the height or thickness of a conventional steel and concrete floor of the type commonly used in hi-rise construction. In some cases a structure may include a combination of conventional flooring with the structurally-integrated flooring according to the principles of the invention. Because the heights are substantially equal, there is no requirement for ramps or height adjustment at transitions from one flooring to the other.

While the embodiment of the invention described with reference to FIGS. 9-15 is shown having particular selected dimensions, the dimensions of the sections 902, the spacing of the rails 904, 906, 912, 916, and 934, the dimensions of the panels 908, and other dimensions and parameters of the system are selectable according to the requirements of a given application, or preferences of the user.

Figure 16:
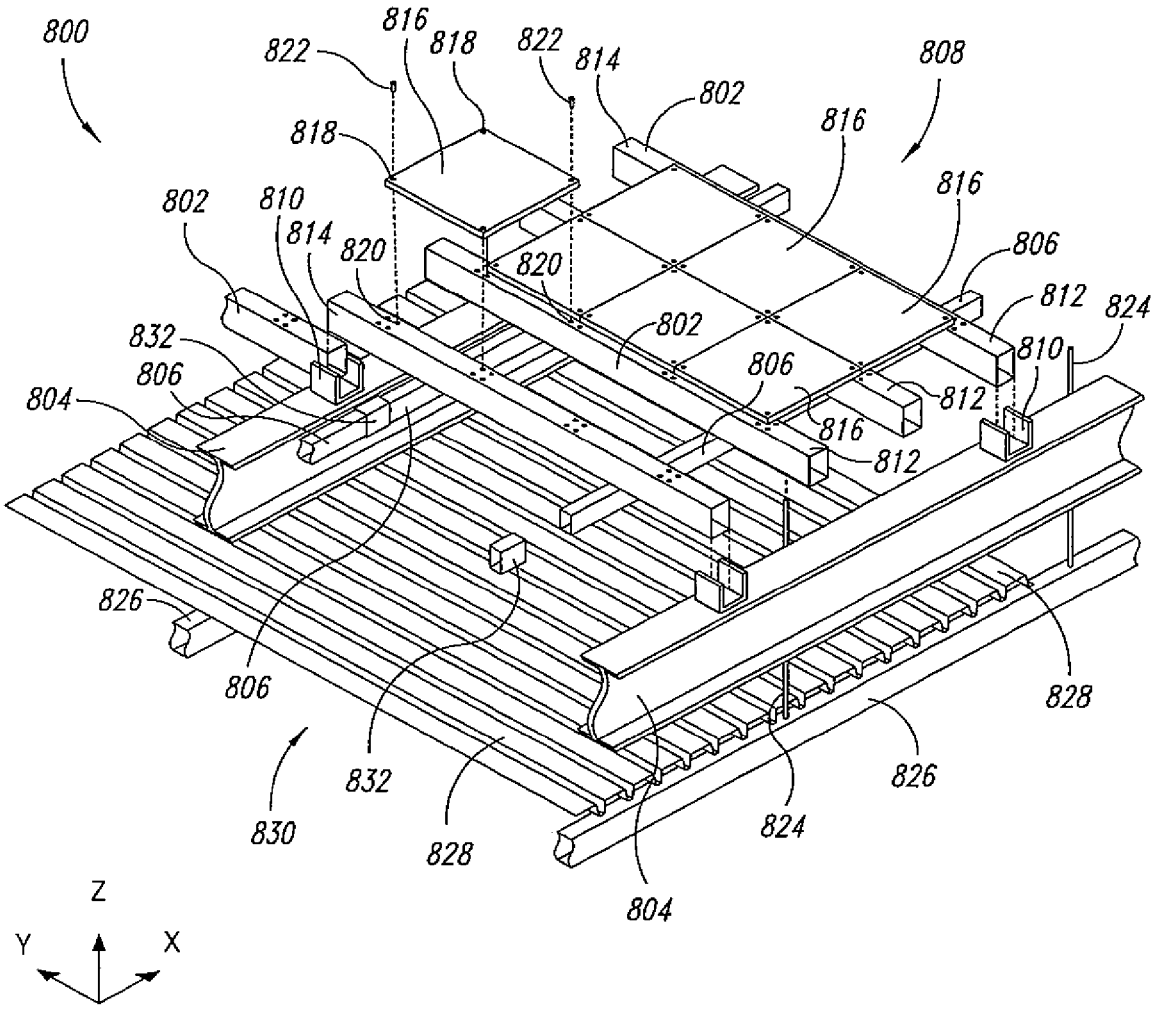
FIGS. 16 and 17 are isometric views of floor systems according to respective embodiments.

Turning now to FIG. 16, a structurally integrated accessible floor system 800 is illustrated, according to another embodiment. Axes X, Y, and Z are labeled to simplify description of the illustrated embodiment, but such designations are not to be construed as limiting the scope of the claims. The system 800 comprises a plurality of grid members 802 lying parallel to the Y-axis and extending between primary framing members 804 of a building. Subfloor rails 806 extend transverse to the grid members 802 and are affixed to bottom surfaces of the grid members 802 to form rigid grid sections 808. Connectors 810 are affixed, typically by welds or bolts, at intervals to upper surfaces of the primary framing members 804. First ends 812 of at least two of the grid members 802 of each grid section 808 are received in corresponding connectors 810 on a first of the primary framing members 804 and second ends 814 of the at least two grid members 802 of each grid section 808 are received in corresponding connectors 810 on a second of the primary framing members 804. Each connector 810 is configured to receive a first end 812 of a grid member 802 of one grid section 808 and a second end 814 of a grid member 802 of an adjacent grid section 808.

Floor panels 816 are positioned to extend between adjacent grid members 802 and to abut with each other so as to form a continuous floor surface. Apertures 818 are provided in each corner of each panel 816, and corresponding apertures 820 are provided in the upper surfaces of the grid members 802. Fasteners 822 are provided and configured to traverse the apertures 818 of the panels 816 and to engage the corresponding apertures 820 of the grid members 802 to securely attach each panel to the rigid grid section 808.

A subfloor deck 830 extends beneath the grid section 808, and comprises hanging fasteners 824, deck support rails 826, and decking material 828. The hanging fasteners 824 are coupled to respective grid members 802 and hang below the grid section 808. The deck support rails 826 are coupled to the hanging fasteners 824 and are thereby supported below the grid section 808, and the decking 828 is in turn supported by the deck support rails 826 and forms the surface of the subfloor deck 830.

According to an embodiment, the grid sections 808 of a building, including grid members 802 and subfloor rails 806, are prefabricated and then installed in the building during construction. The connectors 810 are attached to the primary framing members 804, either prior to delivery of the steel to the building site, or during assembly. The grid sections 808 are lowered onto the framing members 804 until the ends of the grid members 802 engage the connectors 810. The connectors 810 are configured to limit movement of the grid members 802 in the X-axis while permitting movement in the Z-axis. During installation, each grid section 808 is adjusted vertically until it is substantially level, then welded or otherwise affixed to the respective connectors 810 so that the grid section is rigidly held in a level position. As shown in FIG. 16, the grid section 808 is configured to have sufficient strength and rigidity that fewer than all of the grid members 802 need be coupled to the primary framing members 804 by connectors 810. In embodiments where this is the case, the ends 812, 814 of the grid members that are not so coupled are be spaced above the framing members. When a grid section 808 is installed adjacent to another in the Y-axis, with a framing member 804 between, each connector 810 is coupled to a first end 812 of a grid member 802 of one of the sections and to a second end 814 of a grid member of the adjacent section, thereby coupling the respective grid sections 808 to the framing member 804 and to each other. The ends 812, 814 of the grid members 802 that are not received by connectors 810 are joined to each other by appropriate means, such as, for example, butt-welds, gusset plates, etc.

As grid sections 808 are installed adjacent to each other in the X-axis, ends of the respective subfloor rails 806 are positioned very close to, or touching each other. After a grid section 808 is attached to framing members 804, ends of subfloor rails 806 of adjacent grid sections 808 are welded or otherwise rigidly coupled to each other. According to an embodiment, subfloor rail connectors 832 are slid over the ends of each of the subfloor rails 806 of an installed section 808 before installing a grid section 808 that lies adjacent. The adjacent grid section 808 is then installed as described above, which results in the respective subfloor rails 806 of the adjacent grid sections lying with their ends actually or nearly touching. The subfloor rail connectors 832 are then slid back halfway across the joint between rails 806 and welded in place to rigidly couple the two sections 808 together. Where a grid section 808 is positioned adjacent to a framing member that lies parallel to the Y-axis, the corresponding ends of the subfloor rails 806 can be coupled to that framing member, by any appropriate means.

Grid sections 808 that are rigidly coupled together and to primary framing members to become components of a rigid floor grid that is structurally integrated with the associated building, and that is able, not only to support vertical loads, but also to transmit lateral forces, and thus can function as a diaphragm of the building.

After the grid sections 808 of a floor are installed, the hanging fasteners 812, deck support rails 826, and subfloor decking 828 are installed. The hanging fasteners 812 can be coupled to the grid members 802 by any appropriate means. For example, threaded nuts can be welded to the undersides of grid members 802 and the hanging fasteners 812 provided with threads to engage the nuts. Likewise, the deck support rails 826 can be coupled to the hanging fasteners 812 by any appropriate means. Once the deck support rails 826 are in place, the decking 828 is laid across the deck support rails and fastened down by any appropriate means, which can include, for example, welds, adhesives, and mechanical fasteners. The spacing of the hanging fasteners 812 and deck support rails 826 is much greater than the dimensions of the individual floor panels 816, resulting in a subfloor surface that is largely unobstructed by structural elements. In the embodiment of FIG. 16, only one hanging fastener is coupled to each grid section 808. This is in contrast to typical pedestal-type accessible floor systems in which a pedestal is positioned at each corner of each floor panel. The subfloor deck 830 is preferably sized to extend beneath the entire floor, and can be coupled around its perimeter to framing members of the building, in a manner similar to that shown in FIG. 15, in order to function as a building diaphragm.

Panels 816 are installed, with fasteners 822 traversing apertures 818 in the panels and engaging corresponding apertures 820 in the grid members 802. As described in more detail with respect to other embodiments, the panels 816 can be configured to accommodate any specific requirements, including air registers, electrical connectors, etc. Additionally, gaskets can be provided for sound and vibration dampening. Such gaskets can be separate components or integrated with each panel 816, as shown, for example, in the embodiment of FIG. 4.

In the embodiment shown in FIG. 16, the grid members 802 and subfloor rails 806 are lengths of rectangular steel tubing, and the panels 816 are configured to be coupled to the upper surfaces of the grid members and to contact each other to form a continuous floor surface. Accordingly, the panels 816 are sized, at least in one dimension, to be about equal to the center-to-center spacing of the grid members 802. According to other embodiments, the panels 816 are sized and shaped to fit partially or completely between the grid members 802. Additionally, as previously described and illustrated with reference to other embodiments, the grid members can include flanges extending from and running along each grid member to support a lower surface of the floor panels.

In the embodiment shown in FIG. 16, the primary framing members 804 of the building lie parallel to the X-axis on eight-foot centers. Each floor section 808 is eight feet on a side, comprising four eight-foot grid members 802 and two eight-foot subfloor rails 806. The grid members 802 extend parallel to the Y-axis between adjacent primary framing members 804 on two-foot centers. The subfloor rails 806 lie parallel to the X-axis and are centered along the X-axis across the four grid members and are coupled thereto in positions, on the Y-axis, such that when the floor section 808 is correctly positioned, each subfloor rail lies parallel to and about one foot from a center of one of the primary framing members 804. The floor panels 816 are typically two feet on a side, and have sufficient stiffness and strength to span the distance between adjacent grid members 802 while supporting the maximum rated load for a given building floor.

According to various embodiments, the dimensions, load-bearing capacity, and spacing of the individual components of a grid section 808, as well as the overall dimensions of the floor sections, are selected to meet the requirements of the intended application. Such considerations are within the abilities of one of ordinary skill in the art. The maximum dimensions of the floor sections are preferably selected to permit the floor sections to be assembled offsite and transported to the building site. For example, the U.S. Department of Transportation currently imposes a width limit of 102 inches and a length of 48 feet to semi-trailers on interstate highways, although wider or longer loads can be hauled with special permits. A grid section having dimensions of eight feet (96 inches) on a side fits comfortably on a 102 inch flatbed semi-trailer, with six sections fitting lengthwise. Four 8 foot by 12 foot sections would also fit in the same space. A primary consideration in selecting the length of the sections is installation, inasmuch as each section is lifted into place by crane, and longer sections will require more elaborate lifting harnesses and require more time per unit to move into place. Of course, in jurisdictions where trailer size limits vary, the dimensions of grid sections transported by trailer can also be varied accordingly. Furthermore, where grid sections are transported by other means, such as, for example, by water or rail, the dimensions of the grid sections can be selected to make economic use of such transportation.

The length of the hanging fasteners 824 is chosen so as to support the subfloor deck 830 in a selected position relative to the primary framing members 804. According to one embodiment, the subfloor deck 830 is positioned below the primary framing members 804 a distance sufficient to permit passage of utilities such as cables, pipes, and ducts that may be required to extend beneath the framing members. According to other embodiments, the subfloor deck 830 is positioned close against the bottom surfaces of the primary framing members 804, or between the primary framing members. In these embodiments, the utilities are configured to extend over the framing members 804 below the panels 816 and between the grid members 802.

When a row of floor panels 816 extending parallel to the Y-axis between two adjacent grid members 802 are removed, a large opening of about two feet by about six feet is exposed, defined by two grid members 802 on the sides and by two subfloor rails 806 on the ends. This affords a significantly larger working space than the typical two feet by two feet available with prior art accessible floor systems. Additionally, the space between the grid members 802 and the subfloor deck 830, and between the primary framing members 804, is completely unobstructed. It is therefore far simpler, in comparison to traditional accessible floor systems, to service and move materials in the subfloor space. In embodiments where utilities extend over the primary framing members 804, the subfloor rails 806 can be spaced further from the framing members to provide additional working space near the framing members.

Figure 17:
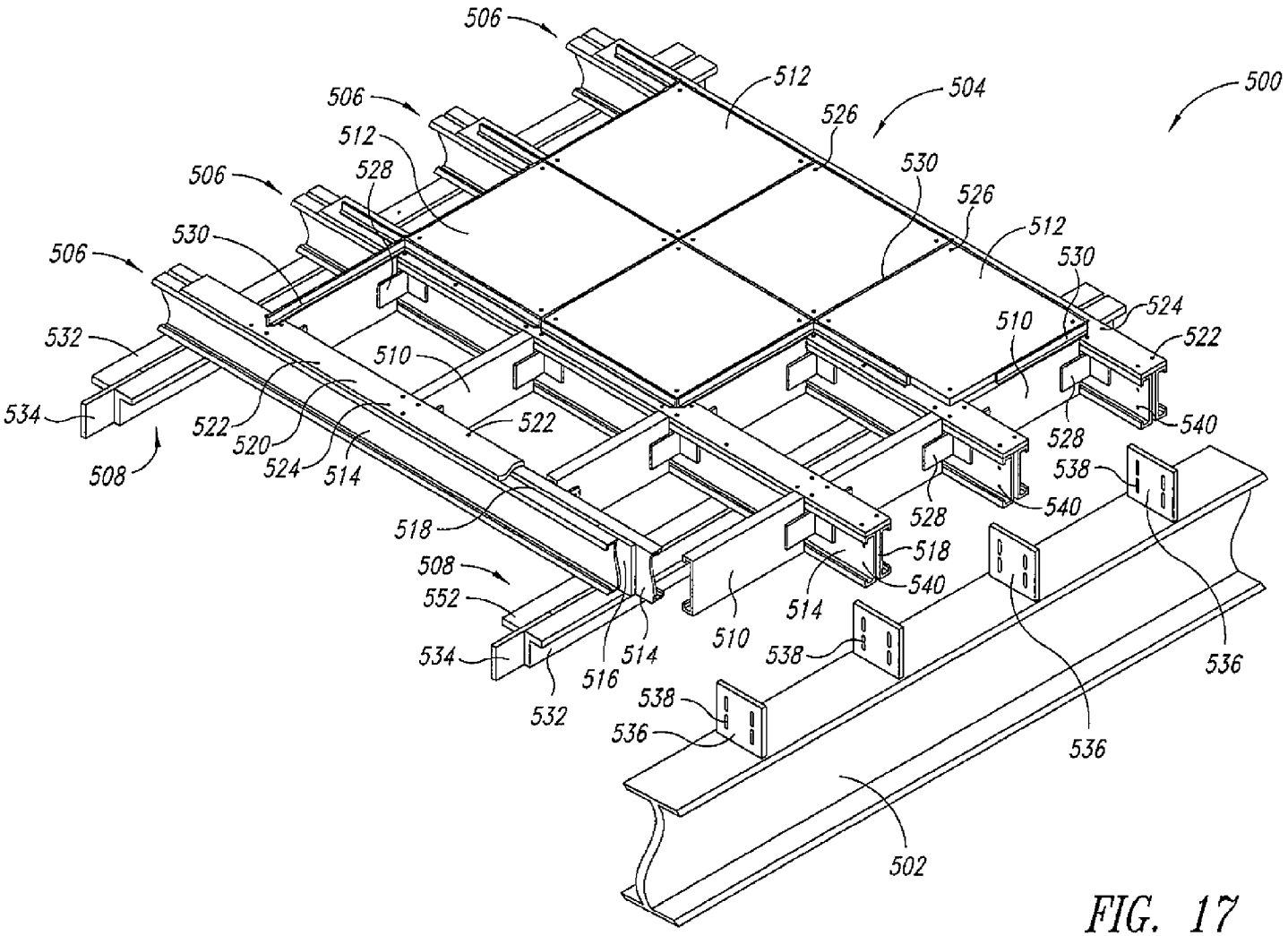

Turning now to FIG. 17, a portion of a structurally integrated floor system 500 is shown, according to another embodiment. The floor system 500 includes a plurality of grid sections 504 coupled to each other and to framing members 502 of the building, with a plurality of removable floor panels 512 positioned on the grid sections to form a continuous floor surface. Each grid section 504 includes a plurality of grid members 506 lying spaced-apart and parallel to a first axis, and a pair of subfloor rails 508 lying parallel to a second axis, rigidly coupled to lower surfaces of the grid members and holding them in position relative to each other. Cross members 510 are coupled by clips 528 to extend between adjacent pairs of grid members 506 at evenly spaced intervals.

Each grid member 506 comprises a pair of beams 514 coupled together with spacers 516 between them to maintain a gap 518, and a plate 520 is coupled to an upper surface of the grid member. The beams 514 are, preferably, cold-formed steel, and are made from heavy gauge sheet metal. The plate 520 is steel and has a thickness, preferably, of about ⅛ inch to ¼ inch. Each of a first plurality of holes 522 in the plate 520 receives a respective sheet metal screw to attach the plate to the beams 514. Each of a second plurality of holes 524 in the plate 520 is threaded to receive a fastener, via a respective hole 526 in a floor panel 512, to couple the floor panels 512 to the grid member 506, permitting repeated removal and replacement of the floor panels. Mounting apertures 540 are provided at each end of the grid members 506, traversing both beams 514 of each grid member.

The beams 514 are shown as having a "C" profile, which is a commonly available profile. However, any profile having the necessary structural characteristics for a given application can be employed. The selection of the appropriate profile is a design consideration that depends on factors such as required load bearing capacity, spanning distance, appearance, compatibility with other building systems, availability, etc., and is within the abilities of one of ordinary skill in the art.

In addition to providing a thickness of steel in which threaded apertures 524 are provided to receive the fasteners by which the floor panels 512 are removably coupled to the grid members 506, plates 520 serve to distribute loads to prevent or minimize deformation of the beams 514 that might result from heavy and concentrated point loads on the floor surface. According to one embodiment in which such load distribution is not required, the plates 520 are omitted, and thread inserts such as are known in the art are affixed to the top surfaces of the beams 514 to receive the floor panel fasteners.

Each subfloor rail 508 comprises a pair of angle members 532 that are coupled together in a spaced-apart relationship. The grid members 506 are rigidly coupled to the subfloor rails 508 by any of a number of acceptable methods, including screws, bolts, welds, adhesive, etc. The subfloor rails 508 of adjacent pairs of grid sections 504 abut end-to-end, and are coupled by connector plates 534 that are received between the angle members 532 of the subfloor rails 508 and extend from one subfloor rail to an abutting subfloor rail.

Connectors 536, each having a plurality of mounting slots 538, are coupled to the upper surface of the framing members 502. They are preferably welded to the framing members, but can be attached by any appropriate method of attachment. The connectors 536 are configured to be received in the gap 518 between the beams 514 of respective grid members 506 during installation of the grid sections 504. The grid members 506 are coupled to the connectors by bolts that extend through the mounting apertures 540 of each grid member 506 and the corresponding mounting slots 538 of the respective connectors 536. Before the bolts are tightened, the elevation of the grid members can be adjusted to level the grid section 504.

Floor panels 512 are mounted to the grid section via threaded fasteners that extend through apertures 526 and engage the threaded holes 524 in the plate 520. Gaskets 530, having, for example, an inverted "T" shape, lie along top surfaces of the grid members 506 and cross members 510, and receive edges of the floor panels thereon, with a portion extending into spaces between adjacent pairs of floor panels.

The cross members 510 serve primarily to provide a sealing surface for the gaskets 530, and so are coupled to the grid members 506 at a height that places a top surface of each cross member flush with top surfaces of the plates 520. This provides coplanar surfaces of the cross members 510 and grid members 506 on which the gaskets 530 can be positioned so that the gaskets can provide an adequate seal between the floor panels and the top of the grid section. The cross members 510 are shown as being made from short pieces of cold-formed steel having the same profile as the beams 514 of the grid members 506. While this arrangement may provide some economic advantages to the manufacturer, it is not essential. Provided the cross members 510 present planar upper surfaces to receive the gaskets 530, they can have any shape and be formed of any material that otherwise meet the strength and rigidity requirements of a given application, and can be omitted entirely in some embodiments.

In the embodiment shown in FIG. 17, the floor panels 512 are about two feet by two feet, and the grid section 504 is about eight feet in the x dimension by about twelve feet in the y dimension, which is a convenient size to be transported by standard flatbed semi-trailer, although the scope of the invention is not limited to these dimensions. Selecting appropriate dimensions for floor panels, grid sections, and other components is a matter of design choice for a given application. A number of factors may influence the selection, including freight costs and dimension constraints, material supply, weight, preferred units of measure, compatibility with other systems in a building, local codes, etc.

While not shown in FIG. 17, the floor 500 can be provided with a subfloor deck as described with reference to other embodiments. Hanging fasteners for the subfloor deck can be coupled to grid members 506 or to the subfloor rails 532. As with other disclosed embodiments, a complete floor structure formed by a number of grid sections can be configured to act as a diaphragm of the building structure into which it is integrated. Likewise, a subfloor deck can also be configured to function as a diaphragm.

According to an embodiment, a fixture is provided that is configured to receive components of a grid section 504 and hold them in their correct relative positions so that an assembler can engage appropriate fasteners to couple the elements, for preassembly of the grid sections, prior to transporting them to a building site to be installed in a building. The assembly fixture is preferably positioned at a height that is convenient to assemblers working on a grid section, and may be configured to be adjustable in height to accommodate different stages of the assembly. The assembly fixture includes fixture beams that are rigidly held in a parallel and spaced-apart relationship at a distance that corresponds to the spacing of the framing members of the building in which the grid sections 504 are to be installed. Upper surfaces of the fixture beams lie in a common plane, within appropriate tolerances for the given application. Assembly connectors are provided that are coupled to the upper surfaces of the fixture beams, which are spaced in correspondence with the spacing of the connectors 536 to which the finished grid section 504 will be coupled when installed in the building. Supports are also provided that are configured to receive the subfloor rails 508 and to hold them in the appropriate position to be attached to the grid members 506.

During assembly, the beams 514 of the grid members 506 are positioned on the assembly fixture and temporarily coupled to the assembly connectors. Preferably, marks or stops are provide on the assembly fixture so that assemblers can correctly position the beams 514 without separately measuring the relative position of each beam. The subfloor rails 508 are also positioned on the assembly fixture. The assembly fixture can also be provided with clamps or supports arranged to hold the beams 514 and rails 508 in position during assembly. With at least the major components held in position by the assembly fixture, an assembler fastens them together to form a grid section 504. In some cases, smaller components, such as the spacers 516, for example, can be positioned by hand during assembly, especially where precise positioning is not essential. In other cases, such as with the cross members 510, in which the positioning is more critical, sub-fixtures can be provided to assist in positioning and attaching the elements. For example, according to an embodiment, once an assembler has coupled together the grid members 506 and subfloor rails 508 of a grid section 504, a sub-fixture configured to hang between a pair of grid members 506 is positioned. The sub-fixture is provided with one or more slots sized to receive cross members 510 and hold them correctly positioned relative to the grid members, so they can be easily attached. The sub-fixture is also provided with stops or marks that are positioned for alignment with the ends of the grid members 506, and other stops that are positioned for alignment with previously attached cross members 510 so that the cross members of a grid section 504 can be accurately positioned and attached without requiring measurement by the assembler.

In the embodiment of FIG. 17, the subfloor rails 508 are disclosed as each comprising a pair of angle members 532 coupled together in a spaced-apart relationship. Subfloor rails 508 can be positioned on the assembly fixture as preassembled subassemblies that are subsequently attached to the grid members 506. Alternatively, the assembly fixture can be configured to receive and hold each angle member 532 so that the angle members can be coupled together to form the subfloor rails 508 during the same process in which the subfloor rails are coupled to the grid members 506. Likewise, other components can be positioned as preassembled subassemblies or can be assembled on the assembly fixture while the grid section 504 is assembled.

The components of the grid section 504 can be largely assembled with self-drilling sheet metal screws such as are well known in the art, although any appropriate fastener or process can be employed to couple the components, including rivets, screws, nuts and bolts, welds or spot welds, adhesives, etc.

According to one embodiment, the plates 520 are affixed to the respective grid members 506 by only two or three fasteners. Then, once the grid section is integrated into the structure of a building with other grid sections, installers can loosen the two or three screws holding the plates to the grid members before attaching all of the floor panels 512 to the plates 520 via the threaded apertures 524. With the screws loosened, the lateral positions of each of the plates 520 of each grid section 504 can be adjusted slightly, in order to make small corrections so that all of the floor panels will fit properly. Once a sufficient number of the floor panels are firmly attached, the installer can retighten the loosened screws and place additional screws in the remaining apertures 522 to securely attach the plates 520 to the beams 514.

According to another embodiment, the plates 520 are laid on the upper surfaces of the grid members 506 and the floor panels 512 are laid over the plates and fastened thereto. The assembly of plates and floor panels is then attached to the grid section 504 by a few screws, e.g., one screw in each corner of the grid assembly, which is sufficient to hold the plates and floor panels in place while being transported to the building site. After the grid section 504 is attached to the framing members 502, the screws holding the plates to the grid section are loosened or removed, and floor panels 512 that bridge between adjacent grid sections are fastened to the pates 520 of the respective sections. Any minor position adjustments necessary to bring all the floor panels 512 into correct alignment are made, after which each of the plates 520 is securely fastened to the respective grid member 506.

According to a further embodiment, one or two large panels are fastened, instead of the floor panels 512, to the plates 520 during initial assembly of the grid sections 504. Each of the large panels is provided with a plurality of holes in positions that correspond to respective ones of the holes 526 in the floor panels 512 and the threaded holes 524 in the plates 520, so that when the large panels are fastened to the plates, the plates are held in the correct positions relative to each other. The large panels are also provided with oversized holes in positions that correspond to the holes 522 in the plates, which are provided for fastening the plates to the grid members 506. After the large panels are attached to the plates 520, the assembly of panels and plates is positioned on the grid section 504 and temporarily attached with a small number of screws, as previously described.

During final assembly of the floor sections 504 to form the floor system 500 in the building, additional floor panels 512 or temporary panels are attached as described above to bridge between the sections, and final position adjustments are made. The plates 520 are then securely attached to the grid members 506 via the oversized holes in the large panels. By providing the oversized holes in the large panels, the plates 520 can be fully secured to the grid members 506 without the necessity of removing panels to access the holes 522 in the plates to place fasteners. The large panels can be removed and returned to the fabricators for use on additional grid sections, or they can remain in place during finish work on the building to provide a surface on which construction workers can stand and move around, and that does not require special protection from common construction site hazards, such as spills or dropped objects. When the building interior is largely finished, the large panels can be removed and reused, and replaced with floor panels 512.

The connectors 536 can be coupled to the framing members 502 at the building site, or prior to transporting the framing members to the site. According to an embodiment, a positioning fixture is provided that includes slots sized and located to receive connectors 536 at the correct spacing. The fixture is temporarily placed over a framing member 502. An operator places connectors 536 in each of the slots, then moves along the framing member and welds each connector to the framing member. The fixture is then removed from the framing member 502, leaving the connectors 536 correctly positioned and attached. If the connectors 536 are to be installed after the framing members of a building are assembled, the fixture can also be provided with an element that aligns with or is coupled to a previously attached connector 536 on another framing member, in order to ensure that when the grid sections are installed, they will fit and interconnect correctly.

The grid sections 504 of the floor system 500 are transported to a building site as preassembled units.

As discussed elsewhere with regard to various embodiments, preassembly of the grid sections provides some important benefits. Additionally, embodiments that employ cold-formed steel components, as described, for example, with reference to FIG. 17, provide additional advantages and benefits. These benefits include high strength to weight ratios, fast assembly, and reduced manufacturing and transportation costs. Finally, because of the forming processes employed, cold-formed components can be made to much closer tolerances with respect to their dimensions. Traditional steel 1-beams and other framing members that are formed in a foundry at very high temperature can deform as they cool, resulting in final dimensions that cannot be held to very close tolerances without additional working and expense. In contrast, cold-formed framing members can be formed to very high dimensional tolerances, meaning that there is less rejection or rework of components during assembly of the grid sections and during installation of the grid sections into a building structure.

In a conventional building, a typical prior art elevated floor system is installed on top of an existing floor. The elevated floor occupies a space above the floor, and is not part of the building structure. The accessible vertical space provided by such an elevated floor is that space between the panels that form the surface of the elevated floor and the upper surface of the solid floor deck. In the structurally integrated accessible floor system of the embodiments of the invention described herein, the solid floor deck is not needed. The removable panels provide access to the space beneath the grid and between the individual secondary framing members. In prior floor structures, this space is inaccessible and wasted. Because the structural support grid of the present invention spans the secondary framing members, the space beneath is unobstructed, providing simplified access for pulling cables and laying conduit, ducting, and pipe.

Building codes in most jurisdictions require that building structures have some degree of resistance or tolerance to earthquake motions, the degree of which may depend on the dimensions of the building and the risk of seismic activity in the particular region. Building structures resist the lateral forces of an earthquake—as well as those exerted by high winds on building faces—by transmitting the lateral forces from upper stories to the ground. The structural elements for transmission of such forces define a building's "load path," and include vertical and horizontal elements that are rigidly coupled together. Vertical elements can include, for example, shear walls, moment frames, and braced frames. Horizontal elements can include one or more diaphragms and the foundation of a building. A diaphragm is a structure that transmits and distributes lateral loads from vertical elements above it in the building to elements below, where the loads are eventually transmitted to the ground via the building foundation. Typically, the floors of a building are engineered to function as diaphragms, while the vertical-load bearing framing members are assembled so as to form moment frames and braced frames to transmit the lateral forces downward toward the foundation. The structural principles described above are very well known in the art.

Structural engineers use the terms rigid, semi-rigid, and flexible to classify the behavior of a diaphragm. In particular, the terms refer to the degree to which a diaphragm will deflect out of the horizontal plane in response to a lateral force, relative to the vertical deflection of the vertical elements in response to the same force. Thus, a diaphragm having a given degree of stiffness can be classified as rigid, semi-rigid, or flexible, depending on the stiffness of the vertical elements to which it is attached. However, such considerations are beyond the scope of the present disclosure. Accordingly, where these terms are used in the disclosure and claims, unless used to modify the term diaphragm, they are not to be construed as referring to the particular classification of a structurally integrated floor or portion thereof, even though a physical embodiment of that floor may be configured to function as a diaphragm, and if so will certainly be subject to such classification.

For the purposes of the present disclosure, the term rigid is to be construed as referring to the stiffness of the element indicated, and if used with reference to a coupling or connection, it refers to the stiffness of the coupled elements relative to the stiffness of the coupling. For example, if two elements are described as being rigidly coupled together, the joint at which they are coupled is no more flexible than the material of the elements. A weld can be considered a rigid coupling because relative movement of elements that are welded is substantially limited by the flexibility of the elements, and can only be exceeded by removing or destroying the weld. This is in contrast to a flexible coupling, in which the joint is more flexible than the elements coupled, permitting some degree of relative movement beyond what would be possible if the elements and joint were all formed in a single piece.

Prior art pedestal based accessible floor systems cannot function as diaphragms for several reasons. First, they are not generally connected to the structure of the building in a way that allows them to receive or transmit lateral forces. Second, their grid elements are not typically coupled rigidly to each other, but instead are clipped or slotted in some fashion to each other and the supporting pedestals. This permits relatively simple on-site assembly, and gives them the flexibility necessary to be adjusted and leveled at each pedestal, but because of the lack of rigid connection, does not provide a reliable load path to transmit forces. Finally, because they are intended to be supported by a rigid floor deck that itself acts as a diaphragm, they are not engineered with such a function in mind.

As noted above with respect to the secondary framing members 104 of FIG. 1 and the connectors 910 of FIGS. 9 and 810 of FIG. 16, the floor system of many of the embodiments can be rigidly coupled to framing members of the building, and can thus provide the load path necessary to transmit lateral forces to and from the floor system, which thus acts as a diaphragm for the building. In some embodiments, where the floor panels are configured to be fastened to the support grid, the installed floor panels enhance the lateral strength of the floor system and contribute to the diaphragm function of the system.

According to other embodiments, in which the floor system is provided with a subfloor deck, such as that described above with reference to FIGS. 10 and 14-16, for example, the subfloor deck can also be configured to function as a diaphragm.

The costs of a structurally integrated floor system according to the principles disclosed herein are significantly mitigated by several factors. A conventional structural floor is not required, and the floor system is essentially the same height as a conventional structural floor, obviating the need for ramps in areas where conventional floors adjoin the floor system. The floor is installed during building construction, saving the added labor of installing an elevated floor after completion of the building. Especially where the floor is installed as prefabricated sections, installation time and labor is less than that of a conventional floor of a building. Additionally, assembly of the sections is done in a factory environment, which is easier and faster than on-site assembly, and permits higher quality control, which in turn results in more accurate and consistent spacing of the components, and less reworking. Because the floor system does not add height per story to the final building structure, there is a savings in building materials, and a savings in operating costs over those of a building with the same number of stories using accessible floors according to the prior art. Where building codes impose height limits on new construction, it may be possible to build more stories within the limits because of the reduction of height per story. Also, because the space under the floor system is substantially unencumbered by pedestals, feet, or other support devices, the floor system has improved flexibility and changeability. Pulling cable, laying conduit and pipe, and installing ducting are all simplified. The labor costs and down time costs are reduced during changeovers. This floor system also allows the incorporation of, and relocation of, egress lighting in the floor system, as a part of the gasket systems, or the vertices of the panels, for example. The gaskets can also be provided with perforations to allow the passage of gas through the gaskets.

An additional cost savings over conventional construction methods is realized by the reduction in structural weight provided by the implementation of an embodiment of the invention. Flooring manufactured according to the principles of the invention can have a per square foot weight of less than half that of conventional high-rise flooring. Such a weight savings can exceed 20 to 30 pounds per square foot, without reducing the weight bearing capacity of the floor. This savings translates to a reduction in the costs of bringing construction materials to a construction site, the costs of assembling a structure, the mass and cost of materials required to support a structure, and finally, affords the architect structural options that were heretofore unavailable due to the weight of the structure.

Advantages of the use of a sub floor space as a plenum for HVAC have been known previously. However, because of the inaccessibility of that space in conventionally constructed buildings, or the cost of conventional removable flooring systems, the associated effort and expense of employing sub floor spaces as plenums have outweighed the benefits, in most cases. With the implementation of the principles of the invention, the costs are much reduced. Sub floor spaces can be easily partitioned such that large areas of a floor have pressurized, conditioned air, to be accessed as desired. Accordingly, ventilation can be inexpensively modified to suit varying needs and preferences, simply by exchanging floor panels with panels having the desired configuration. By the same token, return plenums having negative pressure can also be configured inexpensively. The need for expensive air ducting and channeling can thereby be significantly reduced or eliminated.

The abstract of the present disclosure is provided as a brief outline of some of the principles of the invention according to one embodiment, and is not intended as a complete or definitive description of any embodiment thereof, nor should it be relied upon to define terms used in the specification or claims. The abstract does not limit the scope of the claims.

Terms that refer to relative position or orientation, such as top, bottom, upper, lower, horizontal, vertical, etc., are used with reference to elements as they would be situated when correctly positioned in a completed structure, according to their function.

References to ordinal axes in the drawings and specification, i.e., X-axis, Y-axis, and Z-axis, are to assist in clearly describing the embodiments, and do not limit the claims. Generic references to axes in the claims, e.g., first and second axes, do not necessarily correspond to particular ones of the ordinal axes, unless specifically recited as such.

Ordinal numbers, e.g., first, second, third, etc., are used in the specification and claims for the purpose of clearly distinguishing between elements or features thereof. Unless explicitly stated, the use of such numbers does not suggest any other relationship, e.g., order of operation or relative position of such elements. Furthermore, ordinal numbers used in the claims have no specific correspondence to those used in the specification that refer to elements of disclosed embodiments on which those claims may read.

Elements of the various embodiments described above can be combined, and further modifications can be made, to provide further embodiments without deviating from the spirit and scope of the invention. All of the above U.S. patents, U.S. patent application publications, U.S. patent applications, foreign patents, foreign patent applications and non-patent publications referred to in this specification and/or listed in the Application Data Sheet, are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification, but should be construed to include all possible embodiments along with the full scope of equivalents to which such claims are entitled. Accordingly, the invention is not limited except as by the appended claims.

The invention claimed is:

1. A floor for a building, comprising:

a plurality of spaced-apart framing members, each of the framing members having a substantially planar upper surface that extends in a first direction;

a rigid support grid bearing on the framing members, the support grid including a plurality of grid members having substantially planar upper surfaces that extend in a second direction that is transverse to the first direction, each of the grid members having a first end positioned over one of the plurality of framing members and a second end positioned over an adjacent one of the framing members;

a plurality of floor panels mounted on the support grid to form a floor, each of the plurality of floor panels being individually removable from the support grid to provide access to a space beneath the support grid;

a plurality of connectors, each connector having an opening that receives one of the first end or the second end of a grid members and couples the upper surface of the framing member to the corresponding first end or second end of the grid members;

a plurality of fastening structures hanging from the support grid; and a rigid subfloor deck coupled to the fastening structures and enclosing the space beneath the support grid.

2. The floor of claim 1, comprising fasteners configured to fasten the plurality of floor panels individually to the support grid.

3. The floor of claim 1, comprising an aperture in each of the plurality of floor panels and corresponding apertures in the spaced-apart grid members, and a plurality of fasteners, each configured to traverse the aperture in one of the plurality of floor panels and engage the corresponding aperture in one of the grid members, and thereby fasten the floor panel to the support grid.

4. The floor of claim 1 wherein the second end of another of the plurality of grid members is rigidly coupled to each of the plurality of connectors.

5. The floor of claim 1 wherein the support grid comprises a plurality of cross members, each extending from one of the plurality of grid members to an adjacent one of the plurality of grid members, and wherein the plurality of grid members and the plurality of cross members together define a plurality of openings, each covered by a respective one of the plurality of floor panels.

6. The floor of claim 1 wherein the support grid is coupled to framing members of the building around a perimeter of the floor and configured to receive and transmit lateral loads to and from the framing members.

7. The floor of claim 6 wherein the subfloor deck is coupled to framing members of the building around a perimeter of the floor and configured to receive and transmit lateral loads to and from the framing members.

8. The floor of claim 1, comprising means for leveling the floor.

9. The floor of claim 1 wherein each of the plurality of connectors holds the first end of the respective one of the plurality of grid members a respective selected distance above an upper surface of the one of the plurality of framing members.

10. The floor of claim 1 wherein the rigid support grid comprises a subfloor rail rigidly coupled to a lower surface of at least some of the plurality of framing members.

11. A floor for a building, comprising:

a plurality of prefabricated grid sections, each including:

a plurality of grid members extending parallel to a first axis in a rigid, spaced-apart relationship, each having a first end and a second end, and a plurality of subfloor rails extending parallel to a second axis that is substantially perpendicular to the first axis, each subfloor rail being rigidly coupled to a lower surface of each of the plurality of grid members and thereby holding the plurality of grid members in the rigid, spaced-apart relationship;

each of the plurality of grid sections configured to be coupled at the first ends of at least some of the plurality of grid members of the respective section to a framing member of the building and at the second ends of at least some of the plurality of grid members to another framing member of the building, and having sufficient strength and rigidity to be moved into position and coupled to the first and second framing members of the building as a single preassembled unit and to support the floor load for which the floor is rated solely on the basis of the coupling of the first ends and the second ends of the ones of the plurality of grid members that are coupled to the framing members of the building;

a plurality of connectors, each connector having an opening that receives one of the first end or the second end of a grid members and couples the upper surface of the framing member to the corresponding first end or second end of the grid members;

a plurality of fastening structures hanging from the grid members; and a rigid subfloor deck coupled to the fastening structures and enclosing a space beneath the grid members.

12. The floor of claim 11 wherein each of the plurality of prefabricated grid sections is sized to be transported to a location of the building as an assembled unit.

13. The floor of claim 11 wherein each of the plurality of prefabricated grid sections has one dimension equal to or less than 102 inches.

14. The floor of claim 11, further comprising a plurality of floor panels having a dimension equal to or less than a center-to-center distance between adjacent ones of the plurality of grid members of one of the plurality of grid sections, each of the plurality of floor panels being configured to support the floor load for which the floor is rated while being supported along two opposite edges by adjacent ones of the plurality of grid members of one of the plurality of grid sections.

15. The floor of claim 11, comprising a plurality of floor panels sized and configured to be received by one of the plurality of grid sections, wherein each of the plurality of grid sections is sized to extend between framing members that are spaced apart a distance that is greater than a length or width of any of the plurality of floor panels.

16. The floor of claim 15 wherein each of the plurality of grid sections is sized to extend between framing members that are spaced apart a distance that is equal to or greater than three times a length or width of any of the plurality of floor panels.

17. The floor of claim 11 wherein each of the plurality of grid sections is coupled to adjacent pairs of framing members of the building, thereby forming a continuous floor grid, the floor further comprising:

a plurality of hanging fasteners each coupled to one of the plurality of grid sections and hanging therebelow;

a plurality of deck support rails, each coupled to some of the plurality of hanging fasteners and supported thereby to hang below the floor grid; and a subfloor deck supported below the floor grid by the deck support rails.

18. The floor of claim 17, comprising a plurality of floor panels, each coupled to an upper surface of the floor grid, and wherein the subfloor deck has an unobstructed area that exceeds the area of one of the floor panels.

19. The floor of claim 17 wherein a single one of the plurality of hanging fasteners is coupled to each of the plurality of grid sections.

20. The floor of claim 17 wherein dimensions of the subfloor deck are substantially equal to dimensions of the floor grid, and wherein the subfloor deck is coupled, around a perimeter thereof, to framing members of the building and is configured to function as a building diaphragm.

21. The floor of claim 17 wherein the floor grid is coupled, around a perimeter thereof, to framing members of the building and is configured to function as a building diaphragm.

22. The floor of claim 11, further comprising a plurality of floor panels, and wherein each of the grid sections comprises a plurality of cross members, each extending between a pair of grid members and rigidly coupled thereto, the plurality of grid members and plurality of cross members of each of the plurality of grid sections defining a plurality of openings configured to removably receive a respective one of the plurality of floor panels.

23. A floor structure of a building, comprising:

a floor grid including a first plurality of grid members, each having a first end positioned over a framing member of the building and a second end positioned over an adjacent framing member of the building;

a plurality of panels, each removably positioned with a first edge bearing on one of the first plurality of grid members and a second edge, opposite the first edge, bearing on an adjacent one of the first plurality of grid members;

a plurality of connectors, each connector having an opening that receives one of the first end or the second end of a grid members and couples the upper surface of the framing member to the corresponding first end or second end of the grid members; and a rigid subfloor deck suspended from the floor grid, the subfloor deck including an unobstructed area on its upper surface having dimensions that exceed dimensions of one of the floor panels.

24. The floor structure of claim 23 wherein the subfloor deck comprises:

a plurality of hanging elements coupled at one end to the floor grid;

a plurality of rails, each coupled to some of the plurality of hanging elements; and a surface of decking material supported by the plurality of rails.

25. The floor structure of claim 23 wherein the subfloor deck is configured to function as a building diaphragm.

26. The floor structure of claim 23 wherein the floor grid is configured to function as a building diaphragm.

27. The floor structure of claim 23 wherein the floor grid comprises a plurality of subfloor rails, each of the grid members being rigidly coupled to an upper surface of at least two of the subfloor rails.

28. The floor structure of claim 23 wherein the floor grid comprises a plurality of cross members rigidly coupled to and extending between adjacent pairs of grid members, and wherein each of the plurality of panels is positioned with a third edge bearing on one of the plurality of cross members and a fourth edge, opposite the third edge, bearing on an adjacent one of the plurality of cross members.

29. A rigid subfloor deck for an accessible floor system, comprising:

an accessible floor system, including:

a support grid for supporting a plurality of removable floor panels, the support grid including:

a first plurality of grid members, each having a first end positioned over a framing member of the building and a second end positioned over an adjacent framing member of the building; and a plurality of connectors, each connector having an opening that receives one of the first end or the second end of a grid members and couples the upper surface of the framing member to the corresponding first end or second end of the grid members;

a plurality of hanging elements having respective first and second ends, each coupled at its first end to the support grid of the accessible floor system;

a plurality of rails, each coupled to the second ends of some of the plurality of hanging elements; and rigid decking material extending between and supported by the plurality of rails to form a deck surface.

30. The floor system of claim 29 wherein the subfloor deck is configured to function as a building diaphragm.

31. The floor system of claim 29 wherein the deck surface includes unobstructed areas that exceed the area of a removable floor panel of the accessible floor system.

32. The floor system of claim 29 wherein the deck surface is configured to function as a barrier for use as a plenum.

* * * * *